US008667759B2

(12) United States Patent
Hammer

(10) Patent No.: US 8,667,759 B2
(45) Date of Patent: Mar. 11, 2014

(54) WALL BLOCK SYSTEM

(75) Inventor: James E. Hammer, University Place, WA (US)

(73) Assignee: Westblock Systems, Inc., Salem, OR (US)

( * ) Notice: Subject to any disclaimer, the term of this patent is extended or adjusted under 35 U.S.C. 154(b) by 45 days.

(21) Appl. No.: 13/420,448

(22) Filed: Mar. 14, 2012

(65) Prior Publication Data

US 2012/0233952 A1 Sep. 20, 2012

Related U.S. Application Data

(60) Provisional application No. 61/452,561, filed on Mar. 14, 2011, provisional application No. 61/527,077, filed on Aug. 24, 2011.

(51) Int. Cl.
*E04C 3/30* (2006.01)

(52) U.S. Cl.
USPC ..... 52/575

(58) Field of Classification Search
USPC ..... 52/575, 285.4, 596, 606
See application file for complete search history.

(56) References Cited

U.S. PATENT DOCUMENTS

| | | | |
|---|---|---|---|
| 378,356 | A | 2/1888 | Cohen |
| 1,385,299 | A | 7/1921 | Bilque |
| 1,727,363 | A | 9/1929 | Bone |
| 2,225,612 | A | 12/1940 | Allen |
| 2,235,646 | A | 3/1941 | Schaffer |
| 2,963,828 | A | 12/1960 | Belliveau |
| 3,036,407 | A | 5/1962 | Dixon |
| 3,609,926 | A | 10/1971 | Muse |
| 3,936,987 | A | 2/1976 | Calvin |
| 4,016,693 | A | 4/1977 | Warren |
| 4,110,949 | A | 9/1978 | Cambiuzzi et al. |
| 4,228,628 | A | 10/1980 | Schlomann |
| 4,524,551 | A | 6/1985 | Scheiwiller |
| D319,885 | S | 9/1991 | Blomquist et al. |
| 5,161,918 | A | 11/1992 | Hoel |
| RE34,314 | E | 7/1993 | Forsberg |
| 5,257,880 | A | 11/1993 | Janopaul, Jr. |
| D345,426 | S | 3/1994 | Anderson et al. |
| D347,070 | S | 5/1994 | Anderson et al. |
| 5,417,523 | A | 5/1995 | Scales |
| 5,537,796 | A | 7/1996 | Kliethermes, Jr. |

(Continued)

FOREIGN PATENT DOCUMENTS

| | | |
|---|---|---|
| AT | 4473 U1 | 7/2001 |
| AU | 2002362879 | 4/2008 |

(Continued)

*Primary Examiner* — Jeanette E Chapman
*Assistant Examiner* — James Buckle, Jr.
(74) *Attorney, Agent, or Firm* — Klarquist Sparkman, LLP

(57) ABSTRACT

In some embodiments, a wall block system has at least one block, multiples of the at least one block being suitable for use in constructing a wall from multiple courses of the blocks stacked one upon the other. For example, the wall block system can comprise at least one block having opposed first and second faces, the area of the first face being greater than the area of the second face, wherein the first face or second face can serve as an exposed face on one side of the wall, and each block having an upper surface and lower formed with a single central slot to receive a three-way block-connecting element thereby allowing vertically adjacent blocks in a wall to be interconnected in three different positions to establish a neutral batter, negative batter or a positive batter between blocks in adjacent courses.

29 Claims, 21 Drawing Sheets

(56) References Cited

U.S. PATENT DOCUMENTS

| | | | |
|---|---|---|---|
| 5,540,525 | A | 7/1996 | Miller et al. |
| 5,595,460 | A | 1/1997 | Miller et al. |
| 5,622,456 | A | 4/1997 | Risi et al. |
| 5,711,130 | A | 1/1998 | Shatley |
| 5,816,749 | A | 10/1998 | Bailey, II |
| 5,848,511 | A | 12/1998 | Scales |
| 5,858,511 | A | 1/1999 | Lisowsky |
| 5,984,589 | A | 11/1999 | Ciccarello |
| 6,019,550 | A | 2/2000 | Wrigley et al. |
| 6,024,517 | A | 2/2000 | Castonguay et al. |
| 6,035,599 | A | 3/2000 | Sonnentag |
| 6,115,983 | A | 9/2000 | Poignard |
| 6,149,352 | A | 11/2000 | MacDonald |
| 6,178,715 | B1 | 1/2001 | Pacitto et al. |
| D452,332 | S | 12/2001 | Blomquist et al. |
| 6,488,448 | B1 | 12/2002 | Blomquist et al. |
| 6,615,561 | B2 | 9/2003 | MacDonald et al. |
| 6,637,981 | B2 | 10/2003 | MacDonald |
| 6,827,527 | B2 | 12/2004 | Conkel et al. |
| 6,854,231 | B2 | 2/2005 | MacDonald et al. |
| 6,893,192 | B2 | 5/2005 | MacDonald |
| 6,912,823 | B2 | 7/2005 | MacDonald et al. |
| 6,960,048 | B2 | 11/2005 | Blomquist et al. |
| 7,096,634 | B2 | 8/2006 | Dean, Jr. |
| 7,100,886 | B2 | 9/2006 | Hammer et al. |
| 7,328,537 | B2 | 2/2008 | Hammer |
| 7,503,729 | B2 | 3/2009 | Hammer et al. |
| 7,743,574 | B2 | 6/2010 | Tufts et al. |
| D620,135 | S | 7/2010 | Adam |
| D652,153 | S | 1/2012 | Hammer |
| D652,154 | S | 1/2012 | Hammer |
| D652,155 | S | 1/2012 | Hammer |
| D652,531 | S | 1/2012 | Hammer |
| D665,928 | S | 8/2012 | Hammer |
| D668,792 | S | 10/2012 | Hammer |
| 2002/0001509 | A1 | 1/2002 | Hong |
| 2002/0083657 | A1 | 7/2002 | Mattox et al. |
| 2003/0002925 | A1 | 1/2003 | Blomquist et al. |
| 2003/0070383 | A1 | 4/2003 | Heinle |
| 2005/0102949 | A1 | 5/2005 | Whitson |
| 2006/0201082 | A1 | 9/2006 | Hammer et al. |
| 2008/0193227 | A1 | 8/2008 | Lewis |
| 2008/0277561 | A1 | 11/2008 | MacDonald |

FOREIGN PATENT DOCUMENTS

| | | |
|---|---|---|
| CA | 2463704 | 8/2010 |
| EP | 0170113 A1 | 2/1986 |
| EP | 0498140 A1 | 8/1992 |
| FR | 2.216.823 | 8/1974 |
| FR | 2696201 | 4/1994 |
| GB | 2127872 A | 4/1984 |
| WO | WO 01/57333 | 8/2001 |

WALL BLOCK SYSTEM

CROSS REFERENCE TO RELATED APPLICATIONS

This application claims the benefit of the earlier filing date of U.S. Provisional Patent Application No. 61/452,561, filed Mar. 14, 2011, and U.S. Provisional Patent Application No. 61/527,077, filed Aug. 24, 2011, which applications are incorporated herein by reference in their entirety.

FIELD

The present invention relates to blocks, such as concrete blocks, for constructing structures, such as retaining walls, free-standing walls, and columns.

BACKGROUND

Natural stone blocks cut from quarries have been used for a number of years to assemble walls of various types, including ornamental walls for landscaping purposes. Natural blocks have unique sizes, differences in shape and differences in appearance. However, construction of walls using such blocks requires significant skill to match, align, and place blocks so that the wall is erected with substantially uniform courses. While such walls provide an attractive ornamental appearance, the cost of quarried stone and the labor to assemble the stone blocks are generally cost prohibitive for most applications.

An attractive, low cost alternative to natural stone blocks are molded concrete blocks. In fact, there are several, perhaps hundreds, of utility and design patents which relate to molded blocks and/or retaining walls made from such blocks. Most prior art walls, however, are constructed from dimensionally identical blocks which can only be positioned in one orientation within the wall. Thus, a wall made from molded or cast blocks does not have the same random and natural appearance of a wall made from natural stone blocks.

Accordingly, there is a need for new and improved molded blocks and block systems and methods for constructing walls that have a more natural appearance than walls constructed using molded blocks, block systems, and molded block methods of the prior art.

SUMMARY

Disclosed herein is a wall block system having at least one block, multiples of the at least one block being suitable for use in constructing a wall from multiple courses of the blocks stacked one upon the other, the wall having a front surface with an irregular block pattern. In some embodiments, the wall block system comprises a three-way block-connecting element comprising a lower portion and an upper portion; at least one wall block; the block having an upper surface spaced apart from a lower surface, thereby defining a block height; the block having opposed first and second faces, thereby defining the block depth, the area of the first face being greater than the area of the second face, wherein the block is configured such that the first face or second face can serve as an exposed face on one side of the wall; the block having opposed and non-parallel side surfaces; the block comprising a slot in the block upper surface that is substantially parallel to and equidistant from the first and second faces and a slot in the block lower surface that is substantially parallel to and equidistant from the first and second faces; the first and second blocks configured such that they are capable of being positioned when constructing the wall such that the front surface of the wall is comprised of the first faces of a plurality of the blocks and second faces of a plurality of the blocks to thereby provide an irregular block pattern; the block-connecting element being configured such that when constructing the wall, the block-connecting element can be positioned in one of at least three different positions with the lower portion of the block-connecting element being received in the slot in the upper surface of a block and the upper portion of the block-connecting element being received in the slot in the lower surface of another block in an overlying course, the at least three different positions comprising a first position, a second position, and a third position, the first position establishing a neutral batter between the blocks interconnected by the block-connecting element, the second position establishing a negative batter between the blocks interconnected by the block-connecting element, and the third position establishing a positive batter between the blocks interconnected by the block-connecting element.

In some embodiments of the wall block system, the slot in the block upper surface and the slot in the block lower surface are upper and lower portions, respectively, of a core that extends the entire height of the block.

In some embodiments of the wall block system, the slot in the block upper surface and the slot in the block lower surface each extends at least a majority of a width of the block measured along a line that is substantially parallel to and equidistant from the first and second faces.

In some embodiments of the wall block system, the slot in the block upper surface is uninterrupted along the entire length of the slot.

In some embodiments of the wall block system, the upper and lower surfaces of the block are continuous and uninterrupted except for the slots in the upper and lower surfaces of the block.

In some embodiments of the wall block system, the block further comprises an integral gusset within the core adjacent the lower surface of the block.

In some embodiments of the wall block system, both the first and second faces are formed with roughened surface textures.

In some embodiments of the wall block system, the upper portion of the block-connecting element is horizontally offset from the lower portion of the block-connecting element.

In some embodiments of the wall block system, the block-connecting element further comprises an intermediate flange portion separating the upper and lower portions.

In some embodiments of the wall block system, the lower and upper portions of the block-connecting element each comprises vertically extending, spaced-apart ribs that extend outwardly from one or more sides of the lower and upper portion, respectively.

In some embodiments of the wall block system, the ribs of the lower and upper portion are tapered in height, the ribs of the lower portion extending in a direction from the flange portion to the lower end of the lower portion and the ribs of the upper portion extending in a direction from the flange portion to the upper end of the upper portion so that when inserted into the slot in a block, the ribs contact one or more inner surfaces of the slot of the block to assist in frictionally retaining the block-connecting element within the block.

In some embodiments of the wall block system, the block further comprises a recessed portion formed in the upper surface surrounding the slot in the upper surface, the recessed portion sized to receive the flange portion of the block-connecting element.

In some embodiments of the wall block system, the at least one wall block comprises first, second, and third blocks, the width of each block being different.

In some embodiments of the wall block system, the at least one wall block comprises first and second blocks, the first block having one side surface that is perpendicular to the first and second faces, the second block has two side surfaces that are non-perpendicular to the first and second faces.

In some embodiments of the wall block system, the system further comprises an additional wall block having an upper surface spaced apart from a lower surface, opposed first and second faces of equal size, and opposed, parallel side surfaces that are perpendicular to the first and second faces.

In some embodiments, a method is disclosed for constructing a wall from wall blocks laid in multiple courses, one upon the other, such that the wall has a front surface with an irregular block pattern. In some embodiments, the method comprises providing wall blocks, each of the wall blocks having an upper surface spaced apart from a lower surface, thereby defining a block height, each block having opposed first and second faces, the first face having an area greater than the second face, each block having opposed and non-parallel side surfaces, each block comprising a slot in the block upper surface that is substantially parallel to and equidistant from the first and second faces and a slot in the block lower surface that is substantially parallel to and equidistant from the first and second faces; laying the wall blocks in a first course and a second course overlying the first course such that the front surface of the wall is formed of the first faces of a plurality of the wall blocks and the second faces of a plurality of the wall blocks; and connecting blocks in the first course with blocks in the second course with a plurality of block-connecting elements, each block-connecting element having a lower portion that extends into a slot in the upper surface of a block in the first course and an upper portion that extends into a slot in the lower surface of a block in the second course; wherein each block-connecting element is positionable in one of at least three different positions between a block of the first course and a block of the second course, including a first position that establishes a neutral batter between a block of the first course and a block of the second course, a second position that establishes a negative batter between a block of the first course and a block of the second course, and a third position that establishes a positive batter between a block of the first course and a block of the second course.

In some embodiments of the method, the wall blocks have a roughened surface texture only on the first and second faces; and the act of providing wall blocks comprises providing additional wall blocks that have parallel side surfaces and first and second faces of equal size, and roughened surface textures on both side surfaces and the first and second faces.

In some embodiments of the method, the act of providing wall blocks comprises providing a plurality of identical first blocks having a first width, a plurality of identical second blocks having a second width greater than the first width, and plurality of identical third blocks having a third width greater than the second width.

In some embodiments of the method, connecting the wall blocks in the second course to the wall blocks in the first course comprises connecting the first course to the second course in a manner that results in construction of a substantially vertical wall.

In some embodiments of the method, the upper portion of each block-connecting element is horizontally offset from the lower portion, wherein the block-connecting elements connecting blocks in the first course to blocks in the second course are in the first position in which the upper portion of each block-connecting element is aligned over a slot in the upper surface of a block in the first course.

In some embodiments of the method, connecting the wall blocks in the second course to the wall blocks in the first course comprises connecting the first course to the second course in a manner that results in construction of a front surface which is angled from the vertical.

In some embodiments of the method, the upper portion of each block-connecting element is horizontally offset from the lower portion, wherein the block-connecting elements connecting blocks in the first course to blocks in the second course are in the second position in which the upper portion of each block-connecting element is offset toward to the front of the first course to create a negative batter between the first course and the second course.

In some embodiments of the method, the upper portion of each block-connecting element is horizontally offset from the lower portion, wherein the block-connecting elements connecting blocks in the first course to blocks in the second course are in the third position in which the upper portion of each block-connecting element is offset toward to the rear of the first course to create a positive batter between the first course and the second course.

In some embodiments, a wall is disclosed having a front surface and a rear surface. In some embodiments, the wall comprises at least a first lower course and a second upper course, each course comprising a plurality of wall blocks, each of the wall blocks having an upper surface spaced apart from a lower surface, thereby defining a block height, each block having opposed first and second faces, and opposed side surfaces, each block comprising a slot in the block upper surface that is substantially parallel to and equidistant from the first and second faces and a slot in the block lower surface that is substantially parallel to and equidistant from the first and second faces, wherein at least a portion of the wall blocks in each course have non-parallel side surfaces and first faces having an area greater than the second faces; the blocks being positioned in the first and second courses such that the front surface of the wall comprises the first faces of a plurality of blocks and second faces of a plurality of blocks to thereby provide an irregular block pattern; and a plurality of three-way block connecting elements, each three-way block connecting element comprising a lower portion and an upper portion horizontally offset from the lower portion, the lower portion of each connecting element being positioned in the slot in the upper surface of a block in the first course and the upper portion being positioned in the slot in the lower surface of a block in the second course.

In some embodiments of the wall, the first faces and second faces of the wall blocks have roughened surface textures to give the appearance of natural stone.

In some embodiments of the wall, the upper portion of each block-connecting element is aligned over a slot in the upper surface of a block in the first course to establish a neutral batter between the blocks of the first course and the blocks of the second course.

In some embodiments of the wall, the upper portion of each block-connecting element is offset toward the front of the first course to create a negative batter between the blocks of the first course and the blocks of the second course.

In some embodiments of the wall, the upper portion of each block-connecting element is offset toward to the rear of the first course to create a positive batter between the blocks of the first course and the blocks of the second course.

In some embodiments of the wall, each block comprises a core extending the height of the block, the core defining the slot in the upper surface of the block and the slot in the lower surface of the block.

The foregoing and other features will become more apparent from the following detailed description of several embodiments, which proceeds with reference to the accompanying figures.

DETAILED DESCRIPTION

In the following description, "upper" and "lower" refer to the placement of a block in a retaining wall. The lower, or bottom, surface of a block is placed such that it faces the ground. In a retaining wall, one row of blocks is laid down, forming a lowermost course or tier. An upper course or tier is formed on top of this lower course by positioning the lower surface of one block on the upper surface of another block. Additional courses may be added until a desired height of the wall is achieved. Typically, earth is retained behind a retaining wall so that only a front surface of the wall is exposed. A free-standing wall (i.e., one which does not serve to retain earth) having two exposed surfaces may be referred to as a "fence."

According to a first aspect, a block for constructing a wall is configured to be reversible, that is, each face of the block can be used as the exposed face in a surface of a wall. Typically, one face of the block is larger than the other face of the block, and each face can be used as the exposed face in the front surface of the wall. In some cases, the first face of the block can be the same size as the second, opposed face of the block. According to another aspect, a plug and slot connection system for interconnecting blocks of adjacent courses permits alignment of blocks directly over one another, set forward, or set backward relative to one another so that either vertical or non-vertical walls may be constructed.

Figure 1:
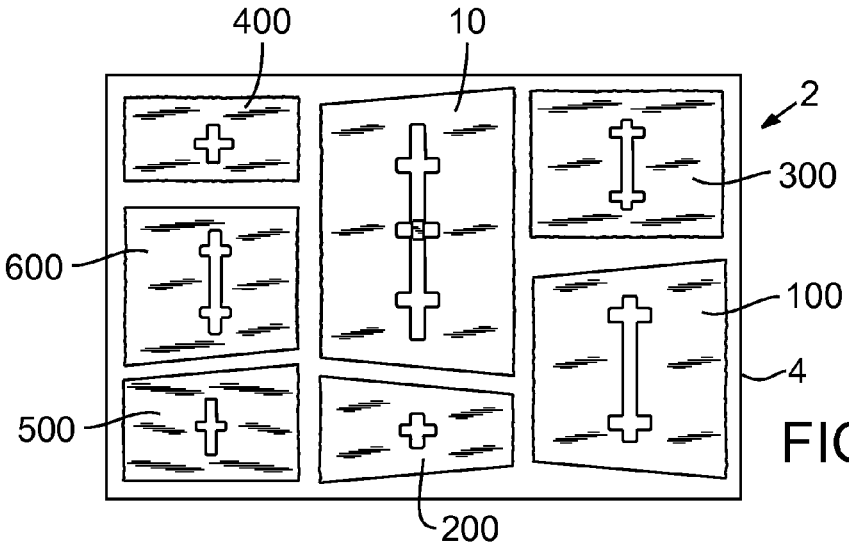
FIG. 1 is a diagram of a mold layout for forming a block system, according to one embodiment.
Figure 2:
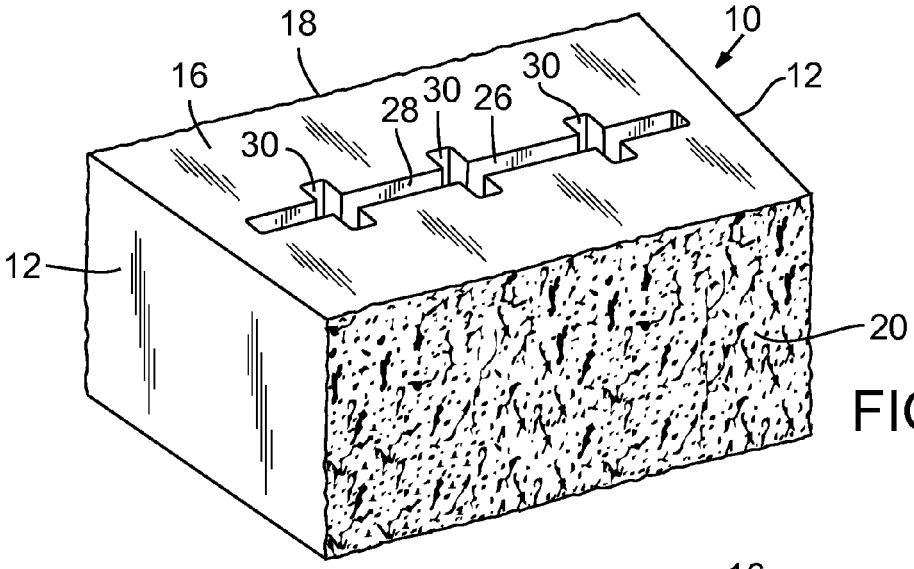
FIG. 2 is a perspective view of a trapezoidal block, according to one embodiment.
Figure 3:
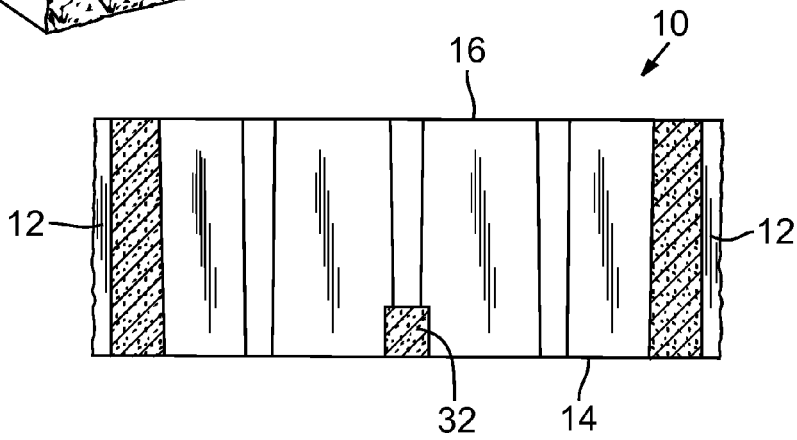
FIG. 3 is a vertical sectional view of the trapezoidal block of FIG. 2.
Figure 4:
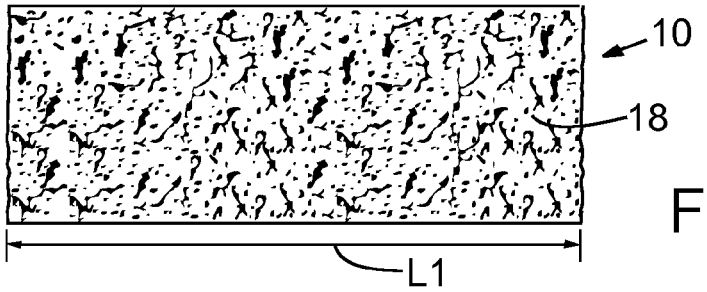
FIG. 4 is a side view of a first face of the trapezoidal block of FIG. 2.
Figure 5:
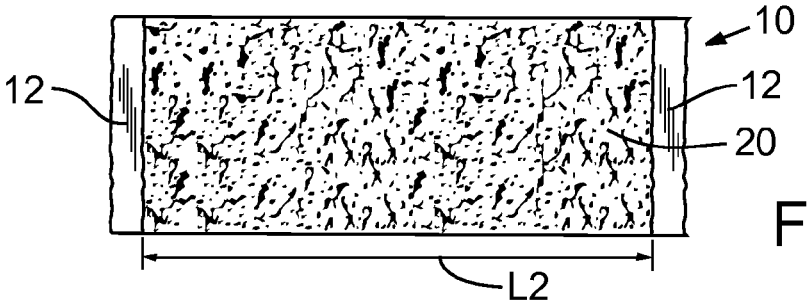
FIG. 5 is a side view of a second face of the trapezoidal block of FIG. 2.
Figure 6:
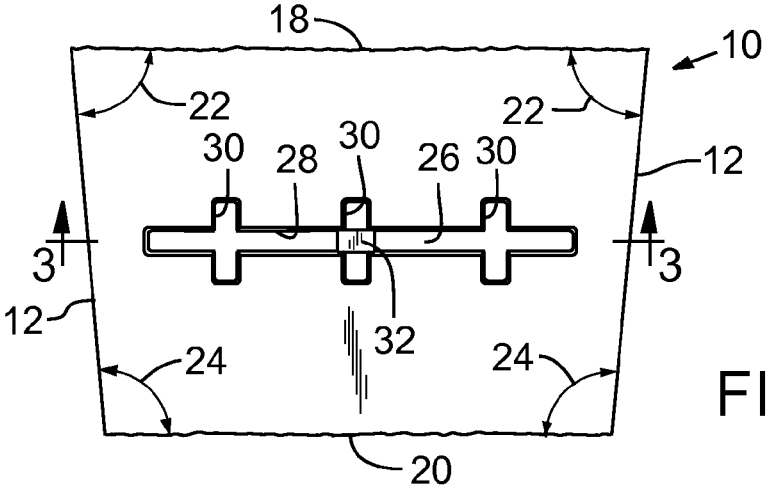
FIG. 6 is a bottom view of the trapezoidal block of FIG. 2.
Figure 7:
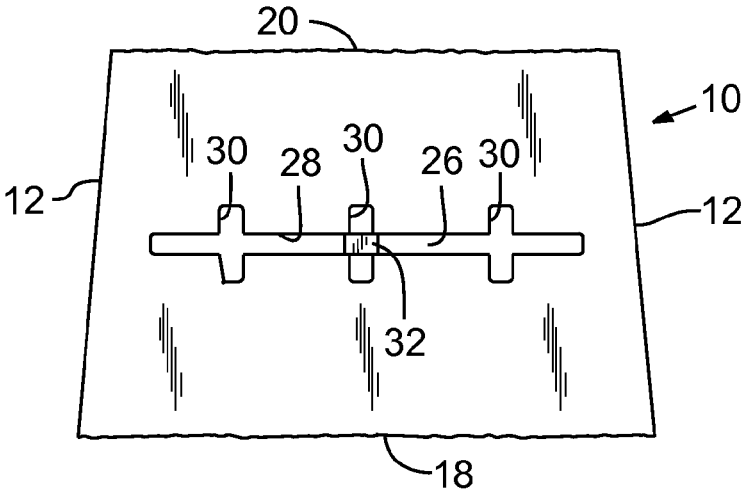
FIG. 7 is a bottom view of the trapezoidal block of FIG. 2.

FIG. 1 shows a mold layout for forming a block system 2, according to one embodiment, in a mold 4. The block system 2 in the illustrated embodiment includes a first trapezoidal block 10, a second trapezoidal block 100, a third trapezoidal block 200, a first rectangular block 300, a second rectangular block 400, a first orthogonal block 500, and a second orthogonal block 600. As used herein, the term "trapezoidal block" means a block having generally parallel first and second faces and non-parallel, converging side walls that are non-perpendicular relative to the first and second faces. As used herein, the term "orthogonal block" means a block having generally parallel first and second faces and non-parallel side walls, one of which side walls is perpendicular (orthogonal) to the first and second faces, and the other of which side walls is non-perpendicular to the first and second faces.

Referring to FIGS. 2-7, the block 10 comprises opposed side walls or side surfaces 12, generally parallel bottom and top surfaces 14, 16, respectively, and generally parallel first and second faces 18, 20, respectively. The side walls 12 taper inwardly, or converge, as they extend from the first face 18 to the second face 20 so that identical acute angles 22 are formed between the first face 18 and side walls 12 and identical obtuse angles 24 are formed between the second face 20 and side walls 12. Hence, the surface area of the first face 18 is greater than the surface area of the second face 20.

In the illustrated embodiment, the side walls converge at the same angles relative to the first and second faces 18, 20. In alternative embodiments, one side wall 12 can be angled at a smaller angle relative to the first face 18 than the other side wall 12 (or a at greater angle relative to the second face 20 than the other side wall).

Desirably, the surface texture of the first face 18 is the same as that for the second face 20. In this manner, the block 10 is "reversible," that is, either the first face 18 or the second face 20 can serve as the exposed face on one side of a wall. Since the first face 18 is larger than the second face 20, a wall constructed from such blocks takes on a more random, natural appearance, than a wall in which the exposed faces of all blocks are equal in size. In the illustrated embodiment, for example, both the first face 18 and the second face 20 are provided with a roughened, split look (as shown in FIG. 1) to contribute to the natural appearance of the wall. The block also may be "tumbled" to round the edges and corners of the block, as generally known in the art. Alternatively, the block 10 may be molded so that either of faces 18, 20 has a smooth, rather than a rough, surface.

The block 10 has a core, or opening, 26 that desirably extends the entire height of the block from the lower surface 14 to the upper surface 16. The core 26 includes a main core section 28 that extends widthwise of the block (i.e., parallel to the first and second faces 18, 20 in a direction from one side wall 12 to the other side wall 12) and one or more minor core sections 30 that extend perpendicular to the main core section 28 in the direction of the depth of the block (i.e., in a direction perpendicular to the first and second faces 18, 20). The main core section 28 desirably is positioned equidistant from the first and second faces 18, 20. The block 10 in the illustrated configuration has three minor core sections 30, one of which is positioned at the middle of the main core section and two other minor core sections that are equally spaced on opposite sides of the centrally located minor core section. In alternative embodiments, the block 10 can have a greater or fewer number of minor core sections and they can be positioned at other locations along the length of the main core section 30. As shown, the core 26 can have a draft, meaning that the cross-section of the core slightly tapers from the upper surface 16 to the lower surface 18. Thus, the length and width of each core section 28, 30 is slightly greater at the top of the block than at the bottom of the block. Providing a draft allows the core former of the mold (the portion of the mold that forms the core 26) to be more easily extracted from an uncured block as it is being removed from the mold. In the illustrated embodiment, except for the core 26, which forms openings at the upper and lower surfaces of the block, the upper and lower surfaces of the block 10 are substantially flat and uninterrupted without any projections, depressions, openings or slots.

The core 26 can be formed with a gusset 32 at the bottom of the block. The gusset 32 is an integrally formed piece of concrete that connects the opposing inner surfaces of the main core section at the bottom of the block. The gusset strengthens the block and helps resists breakage during the tumbling process.

Figure 30:
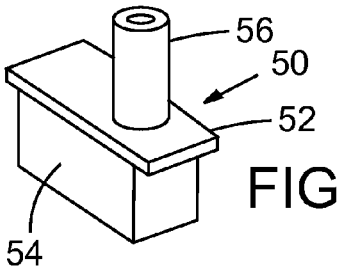
FIG. 30 is a perspective view of a block connecting element, according to one embodiment.

The core 26 cooperates with a block-connecting element 50 (also referred to as a "plug") (FIG. 30) to interconnect vertically adjacent blocks in a wall. A block-connecting element can be used to connect a first block and a second, overlying block by positioning the block-connecting element so as to extend into the upper portion of the core of the first block and into the lower portion of the core of the second, overlying block. The core 26 and the block-connecting element 50 permit vertical, set forward, or set back placement of blocks in a course relative to the blocks in an adjacent lower course. Also, the main core section 28 allows a block to be shifted longitudinally in a course either to the left or the right so that the block is longitudinally offset from a block in an adjacent lower course. Thus, a block in an upper course can be positioned to span two blocks in a lower course in a running bond pattern and can be connected to them with block-connecting elements, one of which extends partially into the core of the upper block and partially into the core of one of the lower blocks and the other of which block-connecting elements extends partially into the core of the upper block and partially into the core of the other of the lower blocks.

The block connecting element 50 includes a lower portion 54, and an upper portion 56 that extends upwardly from the lower portion 54. The upper end of the lower portion forms a flange or lip 52 that protrudes outwardly from the sides and ends of the lower portion 54. In the embodiment shown, the lower portion 54 comprises a generally rectangular body and the upper portion 56 comprises a generally cylindrical or tubular body. The upper portion 56 desirably is offset towards one end of the lower portion 54.

Figure 31:
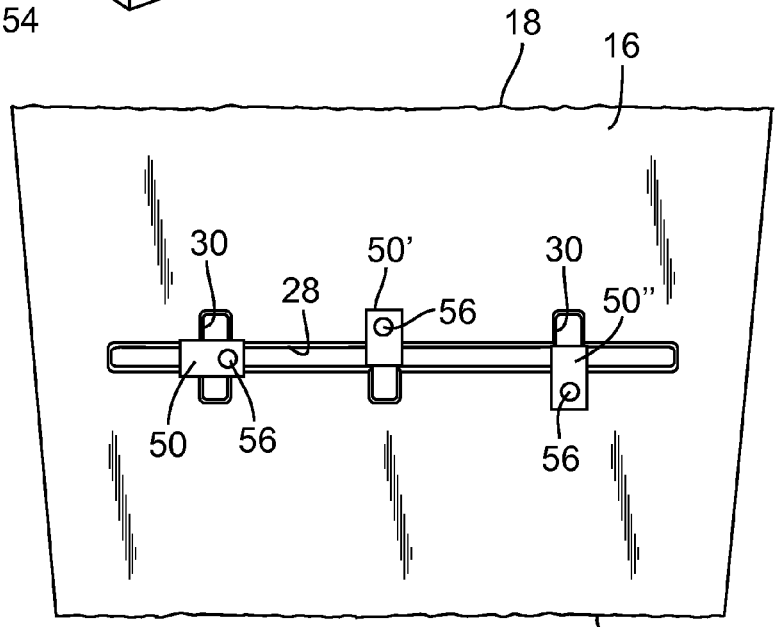
FIG. 31 is a top view of the trapezoidal block of FIG. 2 with a block connecting element.

FIG. 31 illustrates use of the block-connecting element 50 with the block 10. To construct a vertical wall (i.e., a wall having vertically aligned courses) (referred to as a "neutral wall batter"), the lower portions 54 of one or more block-connecting elements 50 can be inserted into the main core section 28. The lip 52 of the block-connecting element contacts the upper surface 16 of the block so to support the upper portion 56 of the block-connecting element above the upper surface of the block. A block of an immediately adjacent upper course is placed over the block 10 such that the upper portion 56 of the block-connecting element 50 extends into the bottom of the main core section 28 of the upper block, thereby interconnecting the two blocks.

To form a set-back wall (i.e., a wall having courses that are set back relative to lower courses) (referred to as a "positive wall batter"), one or more block-connecting elements are inserted into the minor core sections 30 such that the upper portion 56 of each block-connecting element is closer to the back of the wall than the front of the wall. In FIG. 31, the block-connecting element in this position is identified by reference number 50' (assuming that the first face 18 of the block is exposed in the rear face of the wall and the second face 20 of the block is exposed in the front face of the wall). A block of an immediately adjacent upper course is placed over the block 10 such that the upper portion 56 of the block-connecting element 50' extends into the bottom of the main core section 28 of the upper block, thereby interconnecting the two blocks. Because the upper portion 56 is offset toward the rear of the wall, the upper block will be set back relative to the lower block.

To form a set-forward wall (i.e., a wall having courses that are set forward relative to lower courses) (referred to as a "negative wall batter"), one or more block-connecting elements are inserted into the minor core sections 30 such that the upper portion 56 of each block-connecting element is closer to the front of the wall than the back of the wall. In FIG. 31, the block-connecting element in this position is identified by reference number 50" (assuming that the first face 18 of the block is exposed in the rear face of the wall and the second face 20 of the block is exposed in the front face of the wall). A block of an immediately adjacent upper course is placed over the block 10 such that the upper portion 56 of the block-connecting element 50" extends into the bottom of the main core section 28 of the upper block, thereby interconnecting the two blocks. Because the upper portion 56 is offset toward the front of the wall, the upper block will be set forward relative to the lower block.

In the illustrated embodiment, the minor core sections 30 extend the entire height of the block. In alternative embodiments, the minor core sections 30 are open at the upper surface of the block and extend downwardly less than the entire height of the wall. For example, the minor core sections 30 can extend downwardly from the block upper surface a distance sufficient to receive the lower portion 54 of the block-connecting element 50.

The core 28 (including portions 28 and 30) form an opening or slot at the upper surface of the block to receive the lower portion 54 of a block-connecting element and an opening or slot at the lower surface of the block to receive the upper portion 56 of a block-connecting element. In other words, an upper portion of the core 28 forms an opening or slot in the upper surface of the block and a lower portion of the core 28 forms an opening or slot in the lower surface of the block. In an alternative embodiment, the openings or slots in the upper and lower surface need not be formed by a single core that extends the entire height of the block. For example, the upper surface of the block can have an opening or slot in the shape of core 28 that extends downwardly from the upper surface less than the entire height of the block. Similarly, the lower surface of the block can have an opening or slot in the shape of core 28 that extends upwardly from the lower surface less than the entire height of the block. In such an embodiment, the opening or slot in the upper surface can be separated from the opening or slot in the lower surface by a portion of concrete.

The length of the core sections 30 can be increased so that they extend closer to the first face 18 and/or the second face 20. Increasing the length of the core sections 30 in either direction will increase the distance that a block can be set back or set forward relative to an underlying block.

A wall can be constructed entirely from blocks 10, entirely from blocks 100, entirely from blocks 200, entirely from blocks 400, entirely from blocks 500, entirely from blocks 600, or from any combination of blocks 10, 100, 200, 400, 500, and 600. Desirably, each block in set 2 has the same height (distance between the upper and lower surfaces) and depth (distance between the first and second faces) so that a course of a wall formed from blocks 10, 100, 200, 400, 500, and 600 can have a constant height and depth along the length of the course. As described in more detail below, each block 10, 100, 200, 400, 500, and 600 can have a respective core that is adapted to receive block-connecting elements 50 for interconnecting the various blocks to each other in a wall.

Figure 8:
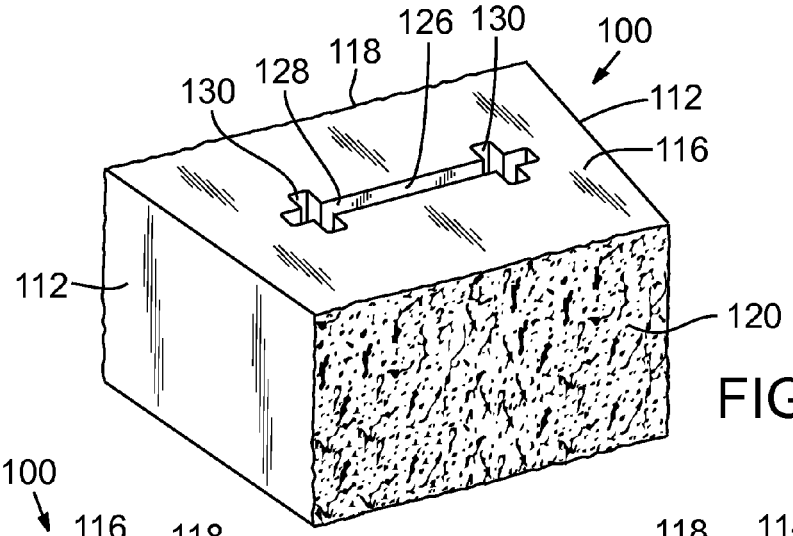
FIG. 8 is a perspective view of a second trapezoidal block, according to another embodiment.
Figure 9:
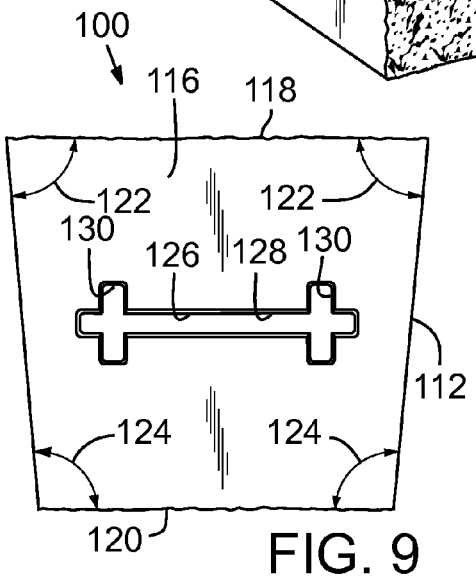
FIG. 9 is a top view of the trapezoidal block of FIG. 8.
Figure 10:
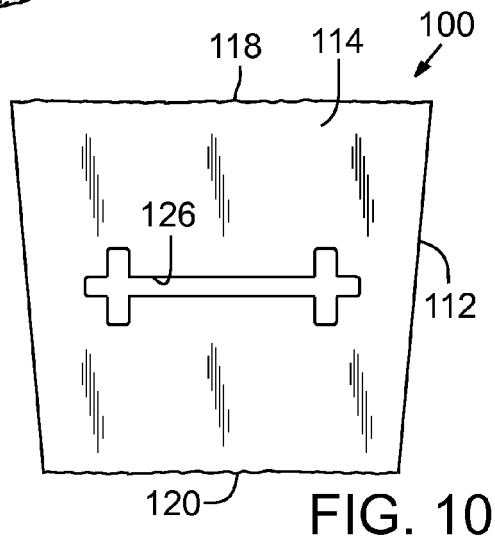
FIG. 10 is a bottom view of the trapezoidal block of FIG. 8.

Referring to FIGS. 8-10, the second trapezoidal block 100 has the same overall shape as the first trapezoidal block but has a width that is smaller than that of the first trapezoidal block 10 (the width of a block being defined as the distance from one side wall to the other along a straight line parallel to the first and second faces of the block). The block 100 comprises opposed side walls or side surfaces 112, generally parallel bottom and top surfaces 114, 116, respectively, and generally parallel first and second faces 118, 120, respectively. The side walls 112 taper inwardly, or converge, as they extend from the first face 118 to the second face 120 so that acute angles 122 are formed between the first face 118 and side walls 112 and obtuse angles 124 are formed between the second face 120 and side walls 112. Hence, the surface area of the first face 118 is greater than the surface area of the second face 120. Like block 10, both faces 118, 120 desirably are provided with a roughened surface texture. The block 100 can be formed with a core 126 for receiving block-connecting elements 50. The core comprises a main core section 128 and two minor core sections 130.

Figure 11:
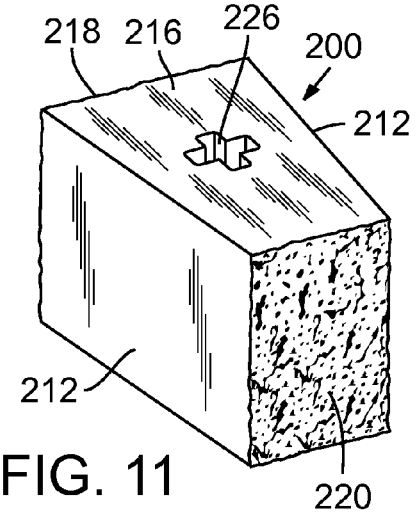
FIG. 11 is a perspective view of a trapezoidal block, according to another embodiment.
Figure 12:
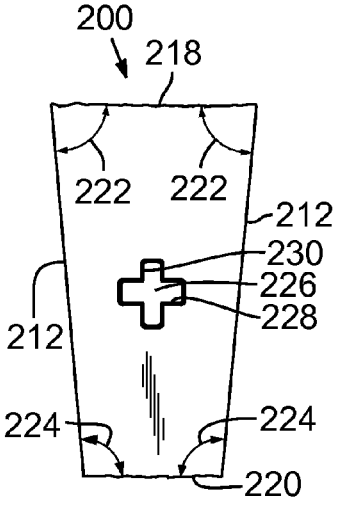
FIG. 12 is a top view of the trapezoidal block of FIG. 11.
Figure 13:
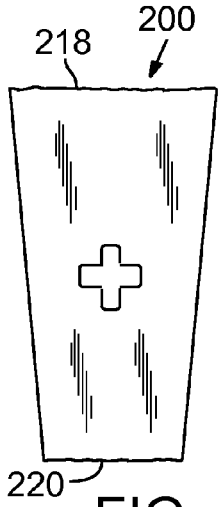
FIG. 13 is a bottom view of the trapezoidal block of FIG. 11.

Referring to FIGS. 11-13, the third trapezoidal block 200 has the same overall shape as the first and second trapezoidal blocks but has a width that is smaller than that of the first and second trapezoidal blocks 10, 100. The block 200 comprises opposed side walls or side surfaces 212, generally parallel bottom and top surfaces 214, 216, respectively, and generally parallel first and second faces 218, 220, respectively. The side walls 212 taper inwardly, or converge, as they extend from the first face 218 to the second face 220 so that acute angles 222 are formed between the first face 218 and side walls 212 and obtuse angles 224 are formed between the second face 220 and side walls 212. Hence, the surface area of the first face 218 is greater than the surface area of the second face 220. Like block 10, both faces 218, 220 desirably are provided with a roughened surface texture. The block 200 can be formed with a core 226 for receiving at least one block-connecting element 50. The core comprises a first core section 228 and a second core section 230.

Figure 14:
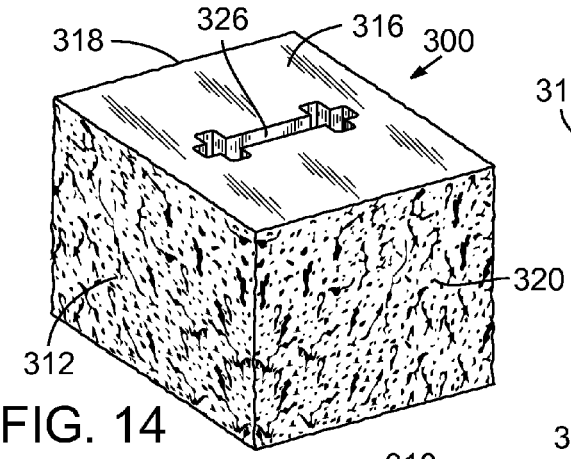
FIG. 14 is a perspective view of a rectangular block, according to one embodiment.
Figure 15:
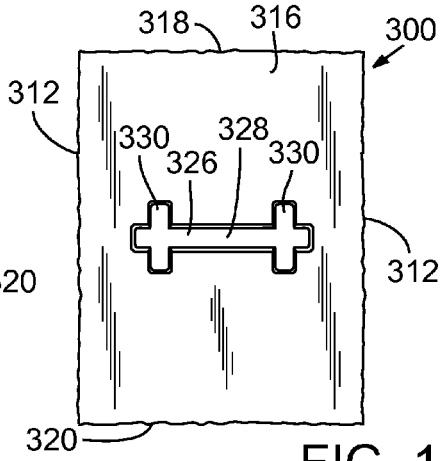
FIG. 15 is a top view of the rectangular block of FIG. 14.
Figure 16:
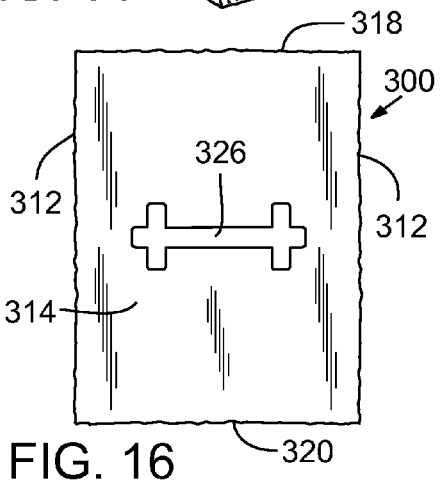
FIG. 16 is a bottom view of the rectangular block of FIG. 14.

Referring to FIGS. 14-16, the first rectangular block 300 comprises opposed, generally parallel side walls or side surfaces 312, generally parallel bottom and top surfaces 314, 316, respectively, and generally parallel first and second faces 318, 320, respectively. Desirably, both faces 318, 320 and both side walls 312 are provided with a roughened surface texture. The block 300 can be formed with a core 326 for receiving block-connecting elements 50. The core comprises a main core section 328 and two minor core sections 330. The faces 318, 320 of the block 300 have the same overall dimensions and area.

Figure 17:
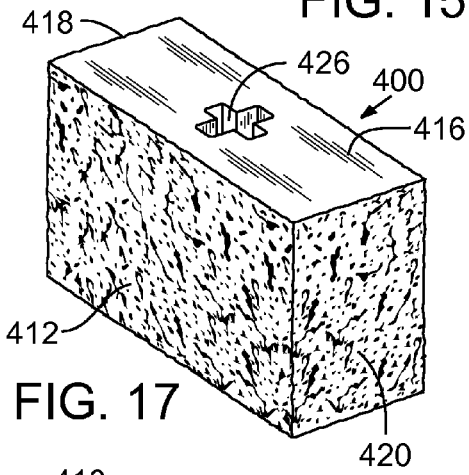
FIG. 17 is a perspective view of a rectangular block, according to another embodiment.
Figure 18:
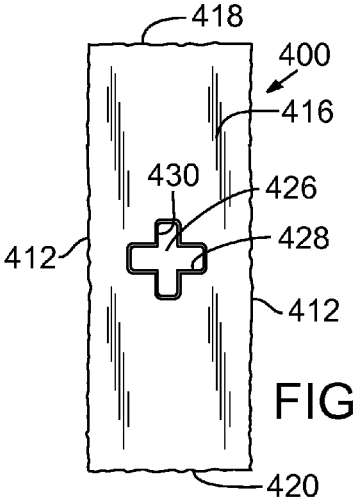
FIG. 18 is a top view of the rectangular block of FIG. 17.
Figure 19:
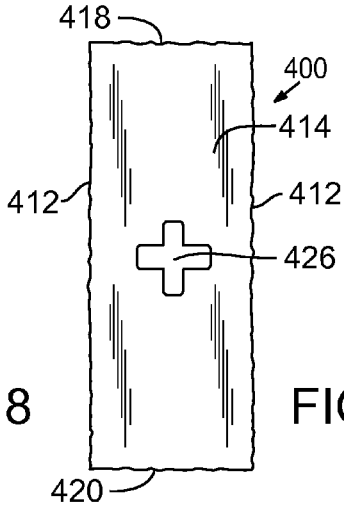
FIG. 19 is a bottom view of the rectangular block of FIG. 17.

Referring to FIGS. 17-19, the second rectangular block 400 has the same overall shape as the first rectangular block 300 but has a width that is smaller than that of the first rectangular block 300. The second rectangular block 400 comprises opposed, generally parallel side walls or side surfaces 412, generally parallel bottom and top surfaces 414, 416, respectively, and generally parallel first and second faces 418, 420, respectively. Desirably, both faces 418, 420 and both side walls 412 are provided with a roughened surface texture. The block 400 can be formed with a core 426 for receiving at least one block-connecting element 50. The core comprises a first core section 428 and a second core section 430. The faces 418, 420 of the block 400 have the same overall dimensions and area.

Figure 20:
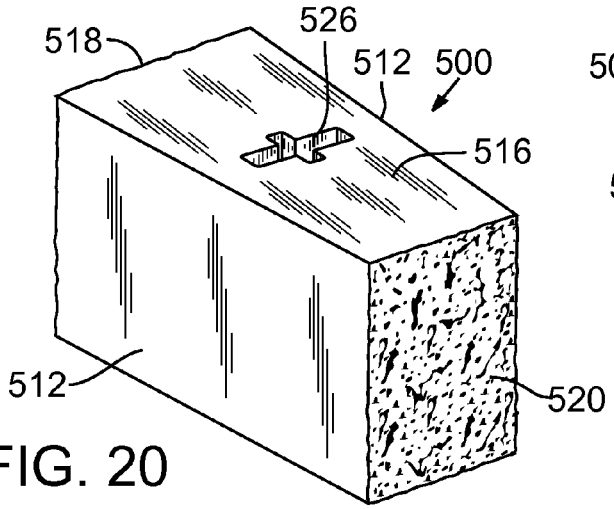
FIG. 20 is a perspective view of an orthogonal block, according to one embodiment.
Figure 21:
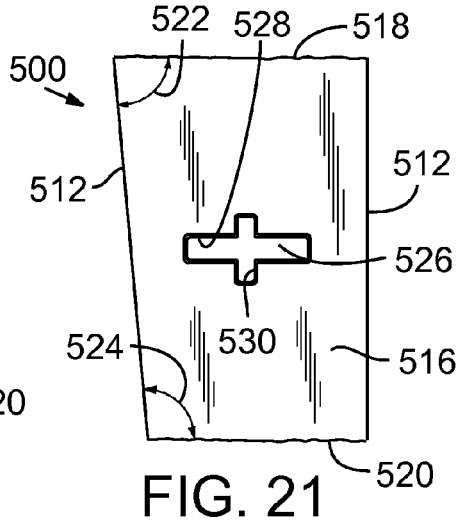
FIG. 21 is a top view of the orthogonal block of FIG. 20.
Figure 22:
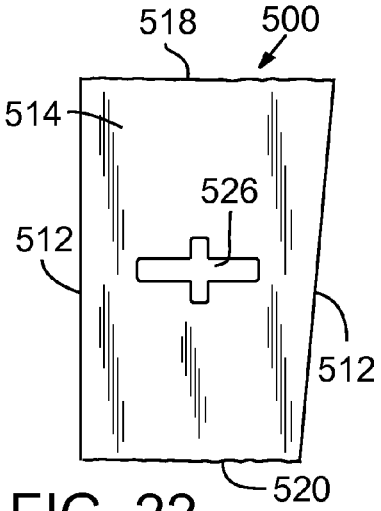
FIG. 22 is a bottom view of the orthogonal block of FIG. 20.

Referring to FIGS. 20-22, the first orthogonal block 500 comprises opposed side walls or side surfaces 512, generally parallel bottom and top surfaces 514, 516, respectively, and generally parallel first and second faces 518, 520, respectively. One side wall 512 is perpendicular (orthogonal) to the first and second faces 518, 520 while the other side wall 512 forms an acute angle 522 with the first face 518 and an obtuse angle 524 with the second face 520. Hence, the surface area of the first face 518 is greater than the surface area of the second face 520. Like block 10, both faces 518, 520 desirably are provided with a roughened surface texture. The block 500 can be formed with a core 526 for receiving block-connecting elements 50. The core can comprise a main core section 528 and one minor core section 530 located at the center of the upper surface and at the middle of the main core section, although additional core sections 530 can be provided.

Figure 23:
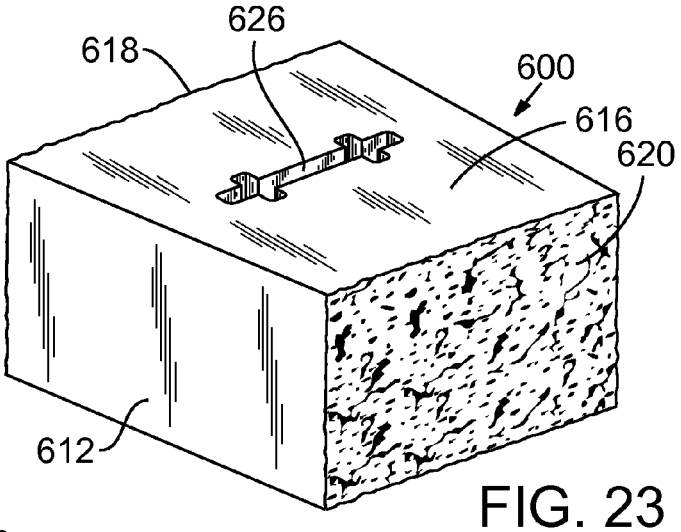
FIG. 23 is a perspective view of an orthogonal block, according to another embodiment.
Figure 24:
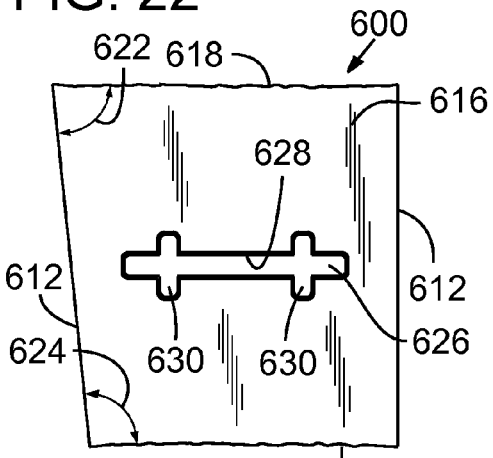
FIG. 24 is a top view of the orthogonal block of FIG. 23.
Figure 25:
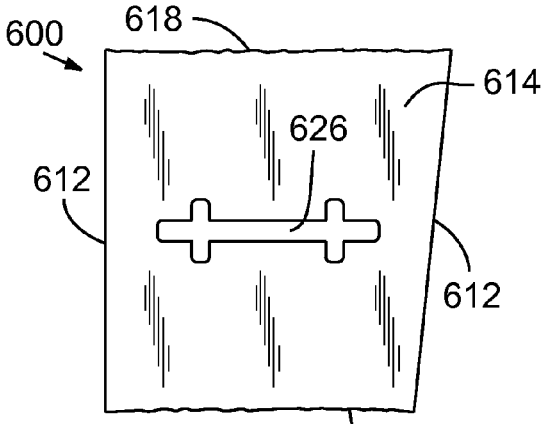
FIG. 25 is a bottom view of the orthogonal block of FIG. 23.

Referring to FIGS. 23-25, the second orthogonal block 600 has the same overall shape as the first orthogonal block but has a width that is greater than that of the first orthogonal block 500. The block 600 comprises opposed side walls or side surfaces 612, generally parallel bottom and top surfaces 614, 616, respectively, and generally parallel first and second faces 618, 620, respectively. One side wall 612 is perpendicular (orthogonal) to the first and second faces 618, 620 while the other side wall 612 forms an acute angle 622 with the first face 618 and an obtuse angle 624 with the second face 620. Hence, the surface area of the first face 618 is greater than the surface area of the second face 620. Like block 10, both faces 618, 620 desirably are provided with a roughened surface texture. The block 600 can be formed with a core 626 for receiving block-connecting elements 50. The core can comprises a main core section 528 and one or more minor core sections 630.

As noted above, each block in set 2 desirably has the same height (distance between the upper and lower surfaces) and depth (distance between the first and second faces). In one specific embodiment, each block 10, 100, 200, 300, 400, 500, 600 has a height of 6 inches and a depth of 10.5 inches. The first face 18 of block 10 has a length L1 (defined as the distance between the side walls 12 at the first face 18) of 16 inches and the second face 20 has a length L2 of 14 inches (defined as the distance between the side walls 12 at the second face 20). The first face 118 of block 100 has a length of 12 inches and the second face 120 has a length of 10 inches. The first face 218 of block 200 has a length of 6 inches and the second face 220 has a length of 4 inches. The faces 318, 320 of block 300 have a length of 8 inches. The faces 418, 420 of block 400 have a length of 4 inches. The first face 518 of block 500 has a length of 7 inches and the second face 520 has a length of 6 inches. The first face 618 of block 600 has a length of 10 inches and the second face 520 has a length of 9 inches. Thus, the blocks 10, 100, 200, 300, 400, 500, 600 provide a total of nine possible face sizes that can be exposed in the surface of a wall. The mold 4 (FIG. 1) can have a length of 36 inches and a width of 22 inches to accommodate forming all seven blocks in the mold. In another embodiment, the blocks 10, 100, 200, 300, 400, 500, 600 can have the dimensions provided above except that each block has a height of 8 inches instead of 6 inches.

As depicted in FIG. 1, all seven blocks 10, 100, 200, 300, 400, 500, 600 can be formed in a single mold 4. The roughened surfaces of the blocks (e.g., roughened faces 18 and 20 of block) can be formed by abrading those surfaces of the uncured blocks as they are removed from the mold. U.S. Pat. No. 7,100,886, which is incorporated herein by reference, describes a mold that has a plurality of projections arranged on the inner surfaces of the mold. The projections are effective to produce a roughened surface texture on the faces of an uncured block as it is removed from the mold. The mold 4 can have a plurality of walls separating each block in the mold. Selected surfaces of the mold wall can be provided with projections, as disclosed in U.S. Pat. No. 7,100,886, in order to form the roughened surface textures on one or more surfaces of each block. Multiple core formers (not shown) supported by a bar above the mold can be used to form the cores in the blocks. In alternative embodiments, the roughened surfaces on the blocks can be formed by conventional splitting techniques.

Advantageously, the blocks can be formed "top up" in the mold; that is, the upper surfaces of the blocks (e.g., upper surface 16 of block 10) face upwardly when they are formed in the mold. This is due to the fact that the cores extend the entire height of the block and therefore can be formed by core formers supported above the mold. As such, the blocks, once removed from the mold, can be palletized, shipped to a job site and/or stored, all in the top up position. This makes handling of the blocks easier when constructing a wall. In contrast, prior art reversible type blocks traditionally have been made top down in the mold because they incorporate pin holes in the upper surface of the block and separate channels in the lower surface of the block, which must be formed using forms supported above the mold. Thus, such prior art blocks must be formed upside down, and must be turned over as the blocks are being stacked for shipping or by the installer at the job site.

Another advantage of the disclosed block configuration is that because the core extends the height of the block, and therefore opens at the upper and lower surfaces of the block, the block actually can be used in a top up or a top down position when constructing a wall and still utilize the block-connecting element 50 for interconnecting vertically adjacent blocks. This greatly simplifies construction of a wall, especially for home owners constructing their own walls without the assistance of a contractor, because the wall can still be constructed properly even if the blocks are laid upside down in the courses.

Another advantage of the disclosed block configuration is that the number of openings in the upper and lower surfaces of the block is minimized, which greatly simplifies construction of a wall, especially for home owners constructing their own walls without the assistance of a contractor. Moreover, in the illustrated embodiment, the upper and lower surfaces of the block are formed with identically shaped openings. In contrast, prior art reversible block systems that permit vertical, set back, and set forward placement of the blocks typically include several rows of pin holes in the upper surface of the block and one or more channels in the lower surface of the block, which can complicate the construction of a wall.

Figure 26:
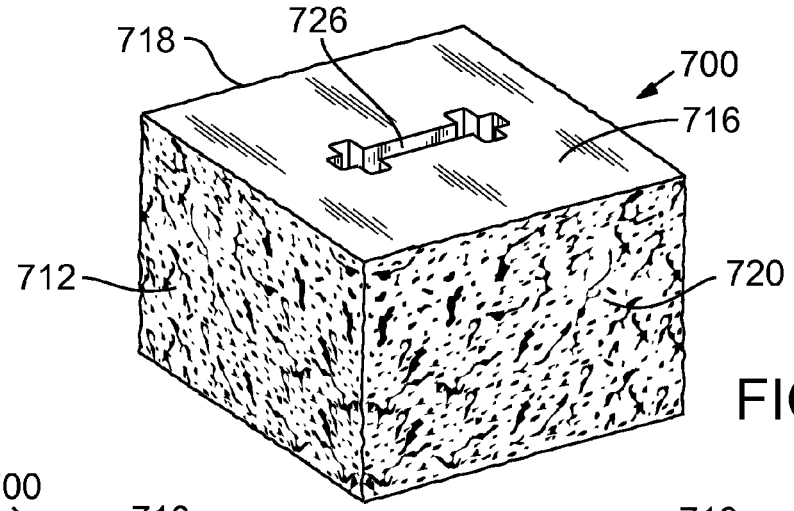
FIG. 26 is a perspective view of a square block, according to one embodiment.
Figure 27:
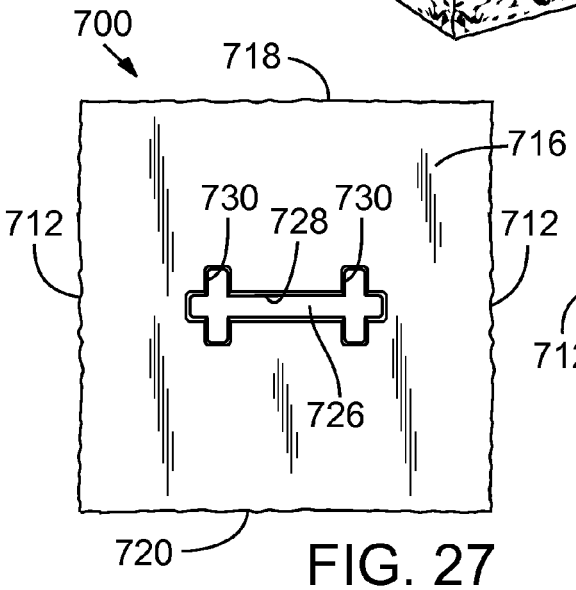
FIG. 27 is a top view of the square block of FIG. 26.
Figure 28:
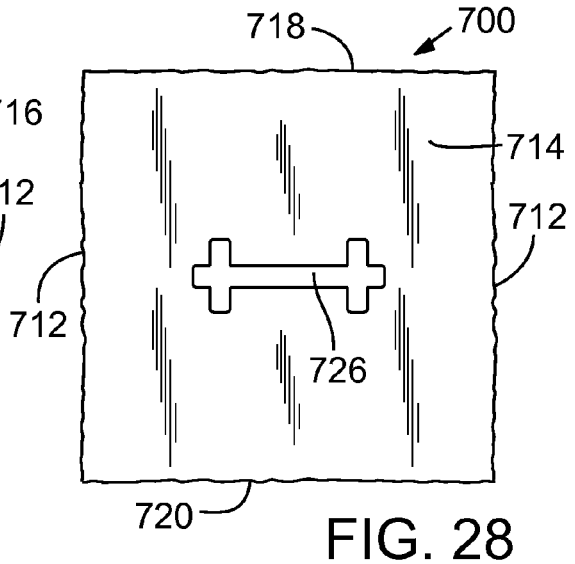
FIG. 28 is a bottom view of the square block of FIG. 26.

FIGS. 26-28 disclose a square block 700 that can be used with one or more of blocks 10, 100, 200, 300, 400, 500, 600 to construct walls. The block 700 comprises opposed, generally parallel side walls or side surfaces 712, generally parallel bottom and top surfaces 714, 716, respectively, and generally parallel first and second faces 718, 720, respectively. Desirably, both faces 718, 720 and both side walls 712 are provided with a roughened surface texture. The block 700 can be formed with a core 726 for receiving block-connecting elements 50. The core comprises a first core section 728 and one or more second, transverse core sections 730. In a specific embodiment, the block 700 has a height of 6 inches, a depth of 10.5 inches and a width of 10.5 inches.

Figure 29:
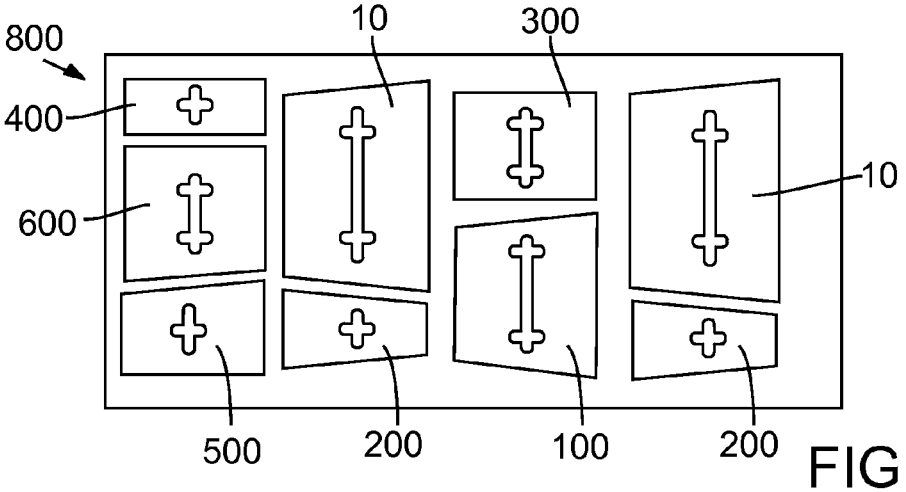
FIG. 29 is a diagram of a mold layout for forming a block system, according to one embodiment.

FIG. 29 shows another example of a mold layout for forming the blocks of set 2. In this embodiment, a mold 800 can be sized to form a block 10, a block 100, two blocks 200, a block 300, a block 400, a block 500, and a block 600. The mold 800 can have a length of 55 inches and a width of 26 inches.

Figure 32:
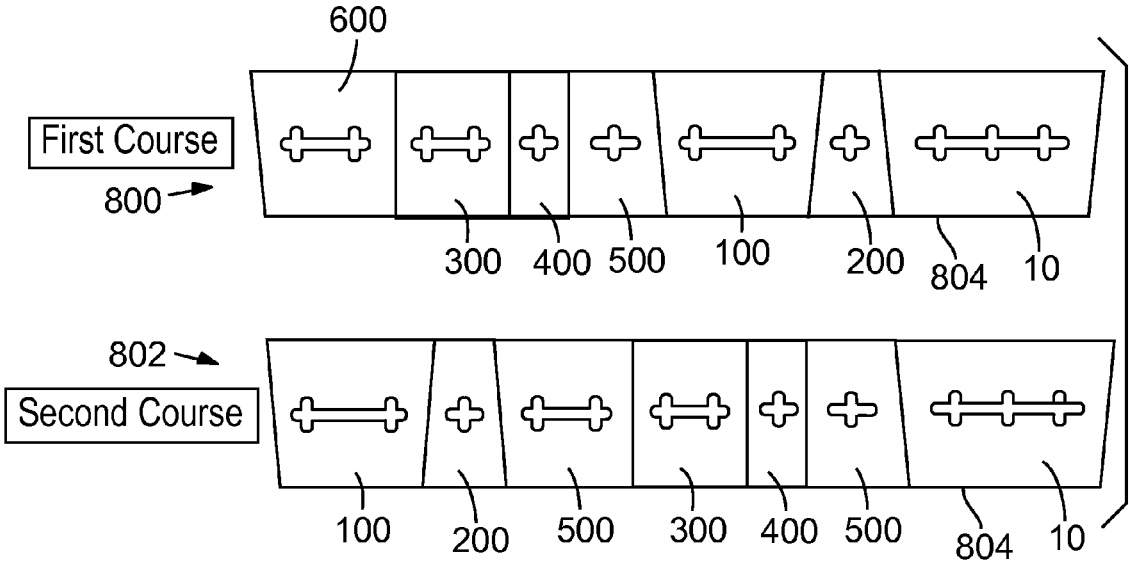
FIG. 32 is a diagram of a layout of a first and second course of wall blocks, according to one embodiment.

FIG. 32 shows the construction of wall formed from blocks 10, 100, 200, 300, 400, 500, 600. The wall includes at least a first course 800 and a second course 802 that sits on top of the first course. As shown, each block is reversible such that either face of each block can be facing forward and exposed in the front surface 804 of the wall. All of the cores of the blocks in each course are aligned along the length of the course. Thus, the block-connecting elements 50 can be used to interconnect the blocks of the first course with the blocks of the second course.

Figure 33:
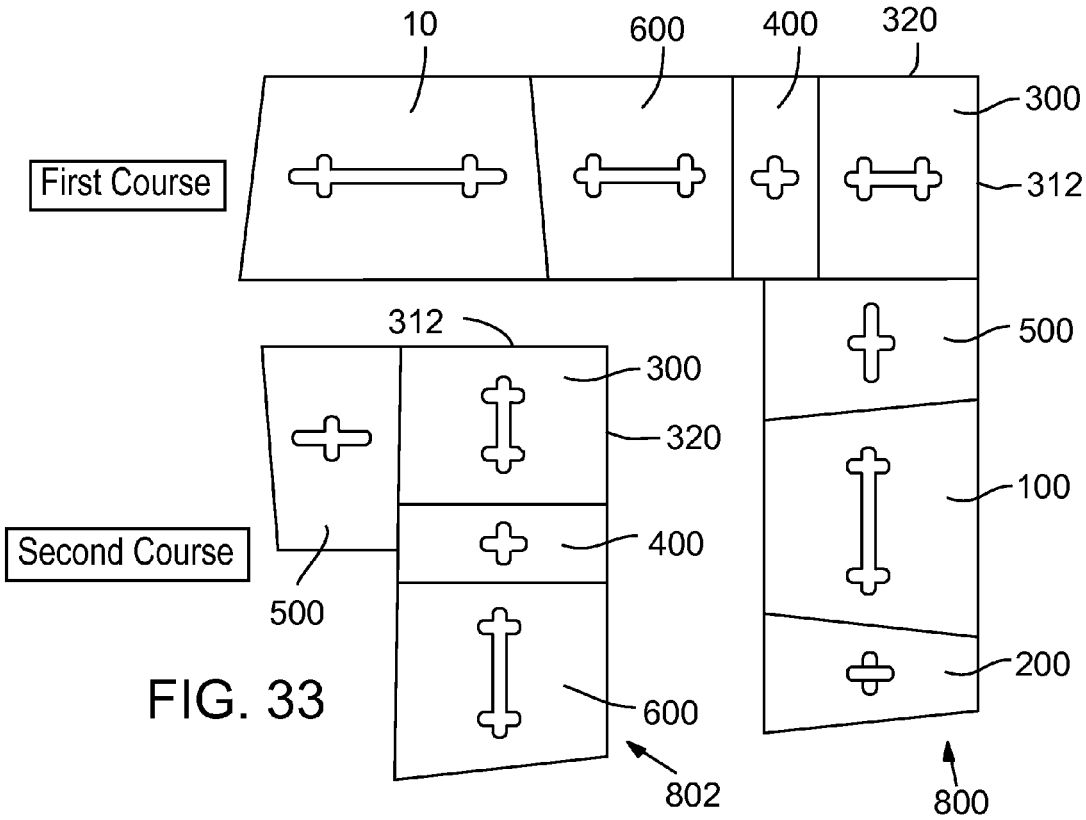
FIG. 33 is a diagram of a layout of a first and second course of wall blocks, according to another embodiment.

FIG. 33 shows an example of how to construct a wall having a 90-degree corner. As can be seen, the rectangular blocks 300, 400 can be positioned at the corner of the wall to form the 90-degree corner. The orthogonal blocks 500, 600 are placed between the rectangular blocks 300, 400 and the trapezoidal blocks 10, 100 to eliminate any gaps between adjacent blocks in each course. As can be seen, the first face 320 and a side wall 312 of each block 300 are exposed in the surface of the wall. As noted above, the rectangular blocks can be formed with roughened surface textures on both faces and both side walls of the blocks.

Figure 34:
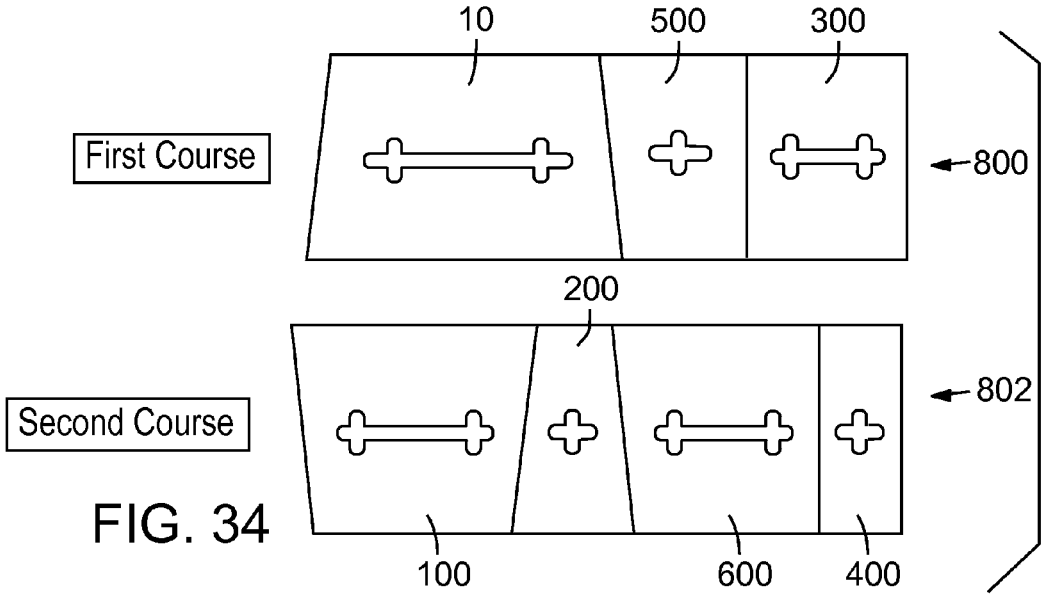
FIG. 34 is a diagram of a layout of a first and second course of wall blocks, according to another embodiment.

FIG. 34 shows an example of how to form a finished or squared end at the end of each course 800, 802. As shown, rectangular blocks 300, 400 are placed at the end of each course to square off the end of the wall and orthogonal blocks 500, 600 are placed between the rectangular blocks 300, 400 and trapezoidal blocks 10, 100, 200 to eliminate any gaps between blocks.

Figure 35:
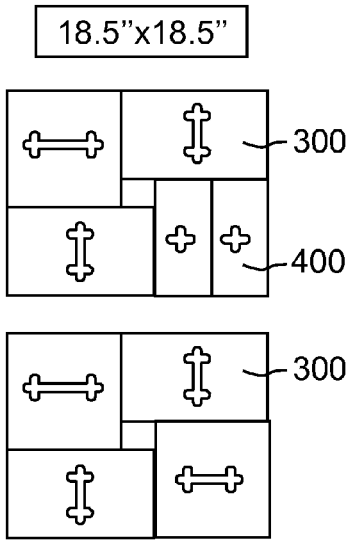
FIG. 35 is a diagram of a layout of a column formed with wall blocks, according to one embodiment.
Figure 36:
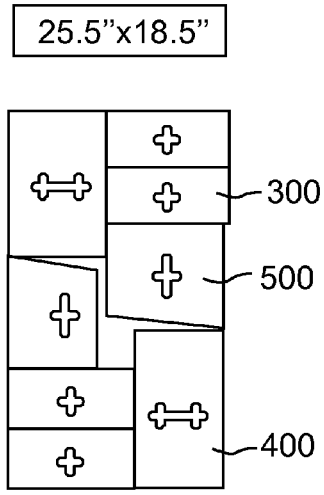
FIG. 36 is a diagram of a layout of a column formed with wall blocks, according to one embodiment.
Figure 37:
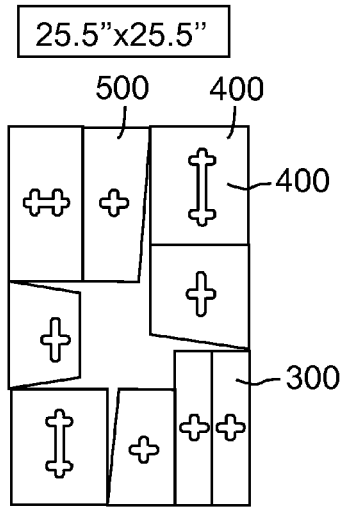
FIG. 37 is a diagram of a layout of a column formed with wall blocks, according to one embodiment.

FIGS. 35-37 show examples of various types of columns that can be formed using blocks 300, 400 and 500. Although not shown, the blocks disclosed herein can be used to form curved or radiused walls. A wall or a section of a wall can be curved by placing the trapezoidal blocks and/or orthogonal blocks with their smaller faces facing in the same direction instead of reversing the positions of the blocks. U.S. Pat. No. 7,328,537, which is incorporated herein by reference, further discloses forming curved walls using trapezoidal shaped blocks.

Figure 38:
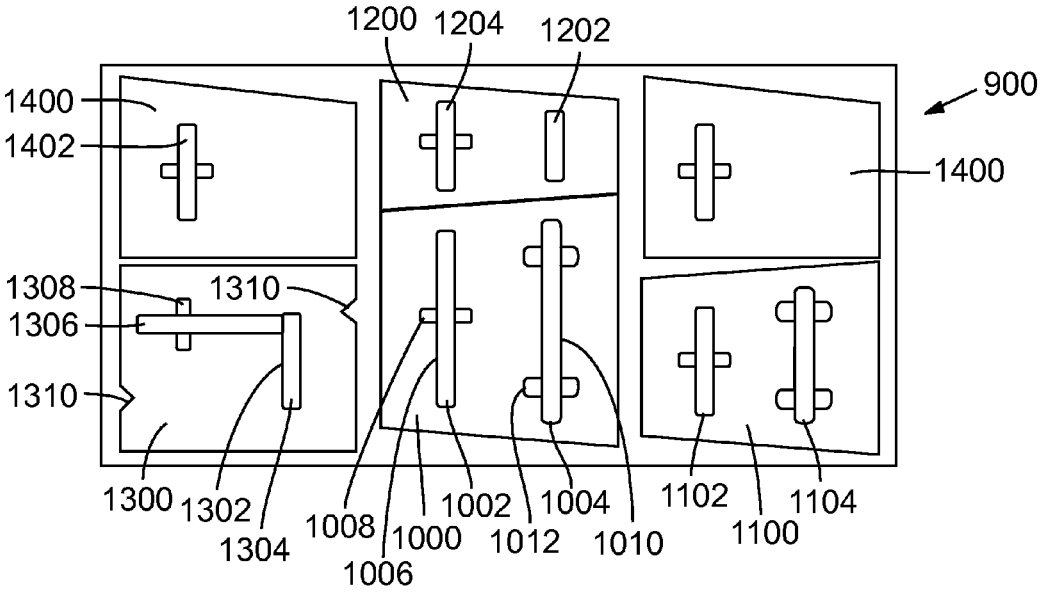
FIG. 38 is a diagram of a mold layout for forming a block system, according to another embodiment.

FIG. 38 shows a mold layout for a set of blocks 900, according to another embodiment. The set of blocks 900 includes a first, large trapezoidal block 1000, a second, medium-sized trapezoidal block 1100, a third, small trapezoidal block 1200, a square block 1300, and two orthogonal blocks 1400.

The trapezoidal blocks 1000, 1100, 1200 can have the same overall shape and configuration of the block 10, except that the blocks 1000, 1100, 1200 can have two cores instead of a single core. For example, the first block 1000 has first and second cores 1002, 1004, respectively. The first core 1002 is spaced closer to the smaller face of the block than the larger face, and the second core 1004 is spaced closer to the larger face of the block than the smaller face. The first core 1002 can have a main core section 1006 and a minor core section 1008 positioned at the middle of the main core section 1006. The second core can have a main core section 1010 and two minor core sections 1012.

The second trapezoidal block 1100 likewise can have similarly shaped first and second cores 1102, 1104, respectively. The third trapezoidal block 1200 similarly can have first and second cores 1204, 1204, one or both of which can have minor core sections. Each orthogonal block 1400 can have a core 1402 that can be offset toward the larger face of the block. In other embodiments, each orthogonal block 1400 can have two cores, similar to the trapezoidal blocks 1000, 1100, 1200. The orthogonal blocks 1400 can be the same or different sizes. For example, one orthogonal block 1400 can have a greater width than the other orthogonal block 1400.

The square block 1300 can have an L-shaped core 1302 comprising a first leg 1304 and a second leg 1306. The second leg 1306 can have a transverse or minor core section 1308. The opposing faces of the square block 1300 can be formed with notches, or scores, 1310 that extend the height of the block. The scores 1310 provide a separation in the faces of the blocks to give the appearance that each face is comprised of faces of two separate blocks.

Block-connecting elements 50 can be used to interconnect blocks 1000, 1100, 1200, 1300, 1400 in a wall. Thus, after laying a first course of a wall, one or more block-connecting element 50 can be inserted into the upper portions of the cores of the blocks. With respect to the trapezoidal blocks, the block-connecting elements can be positioned in one or both of the main core sections, such as for constructing a vertical wall, or in one or more of the minor core sections, such as for constructing set-back or set-forward walls. The square block 1300 is especially adapted for use at the end of a course or for forming a 90-degree corner in a wall. When forming a 90-degree corner, the first leg 1304 of the core 1302 can be connected via a block-connecting element 50 to a vertically adjacent block of a course that extends in the direction of the length of the first leg, while the second leg 1306 can be connected via a block-connecting element 50 to a vertically adjacent block of a course that extends in the direction of the length of the second leg. Thus, it can be seen that the L-shaped core 1302 of the square block facilitates the connection to blocks of a different course at the corner of a wall using block-connecting elements 50.

Figure 39:
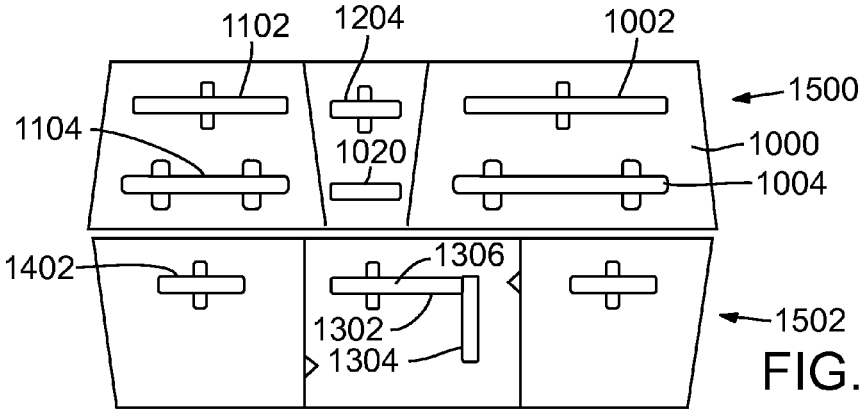
FIG. 39 is a diagram of a layout of a first and second course of wall blocks, according to another embodiment.
Figure 40:
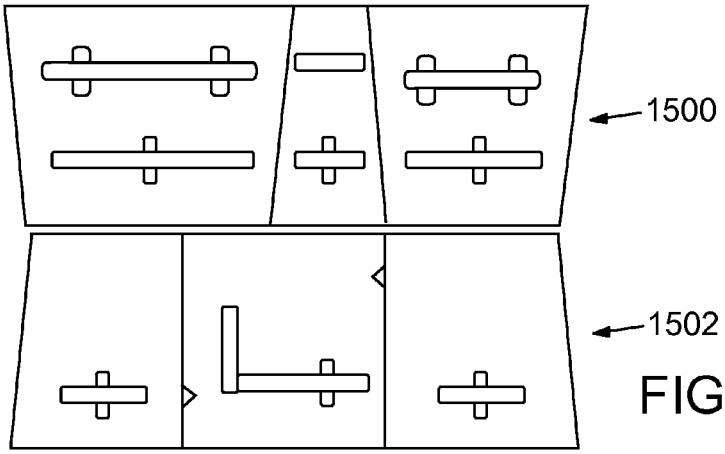
FIG. 40 is a diagram of a layout of a first and second course of wall blocks, according to another embodiment.
Figure 41:
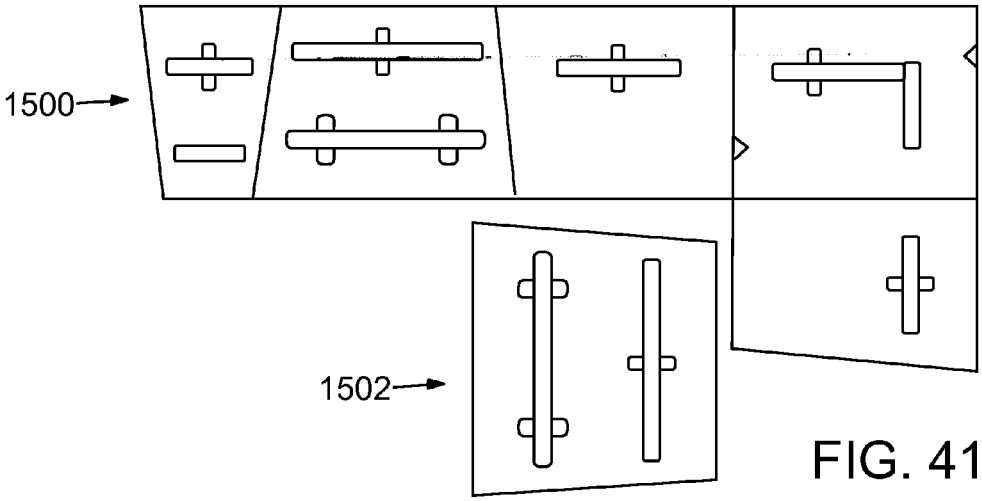
FIG. 41 is a diagram of a layout of a first and second course of wall blocks, according to another embodiment.

FIGS. 39-41 show various layouts for placing blocks 1000, 1100, 1200, 1300, 1400 in first and second courses 1500, 1502, respectively, of a wall. In the embodiment shown, the cores of a block do not necessarily align with the cores of an adjacent block. For example, the cores 1002, 1004 of the first trapezoidal block 1000 can be spaced equidistant from the first and second faces of the block (i.e., the first core 1002 is spaced from the smaller face the same distance that the second core 1004 is spaced from the larger face), but the respective cores of the second and third trapezoidal blocks 1100, 1200 can have different spacing between the block faces and the adjacent cores. In alternative embodiments, the cores can be formed in the blocks such that the cores in each block align with cores of the other blocks in a course. In other words, the first and second cores of each trapezoidal block can be equally spaced from respective faces of the block, and the orthogonal blocks and the square blocks can incorporate the same spacing between cores and respective faces of the blocks.

Figure 42:
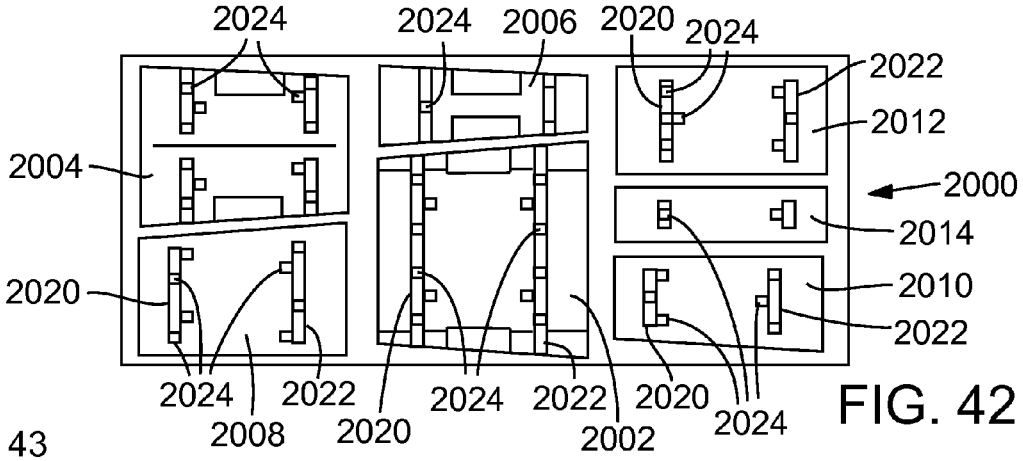
FIG. 42 is a diagram of a mold layout for forming a block system, according to another embodiment.

FIG. 42 shows a mold layout for forming a set of blocks 2000 comprising a first, large trapezoidal block 2002, a second, medium-sized trapezoidal block 2004, a third, small trapezoidal block 2006, a first, large orthogonal block 2008, a second, smaller orthogonal block 2010, a first, large rectangular block 2012, and a second, small rectangular block 2014. The blocks of set 2000 can have a pin and slot connection similar to that disclosed in U.S. Pat. No. 7,328,537. Accordingly, each block can have first and second channels 2020, 2022 formed in the lower surface of the block, and a plurality of pin holes 2024 formed in the upper surface of the block.

Figure 43:
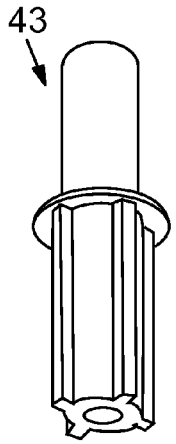
FIG. 43 is a perspective view of a block connecting element, according to another embodiment.
Figure 44:
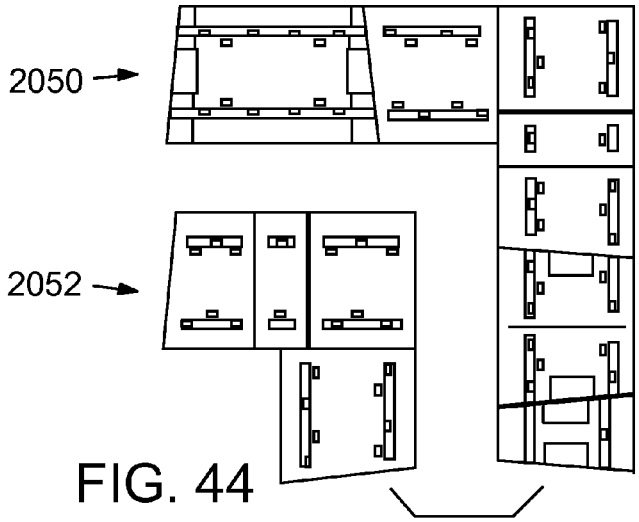
FIG. 44 is a diagram of a layout of a first and second course of wall blocks, according to another embodiment.
Figure 45:
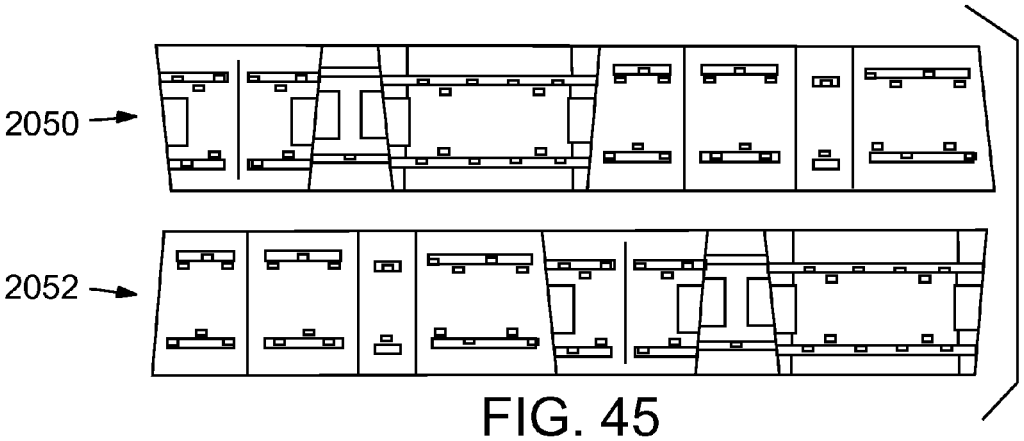
FIG. 45 is a diagram of a layout of a first and second course of wall blocks, according to another embodiment.
Figure 46:
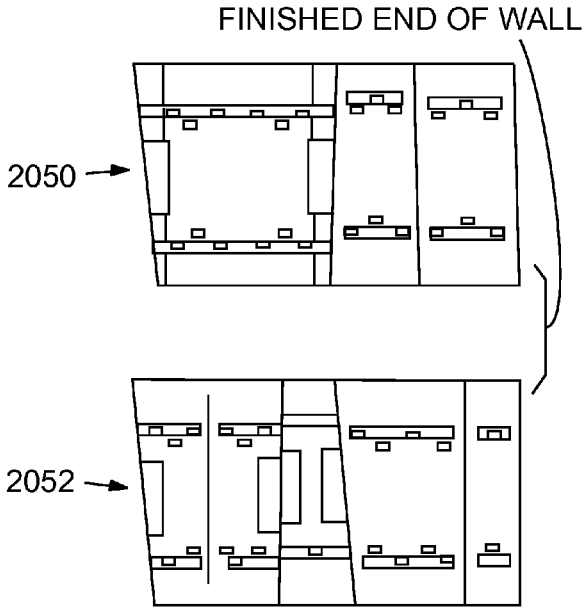
FIG. 46 is a diagram of a layout of a first and second course of wall blocks, according to another embodiment.
Figure 47A:
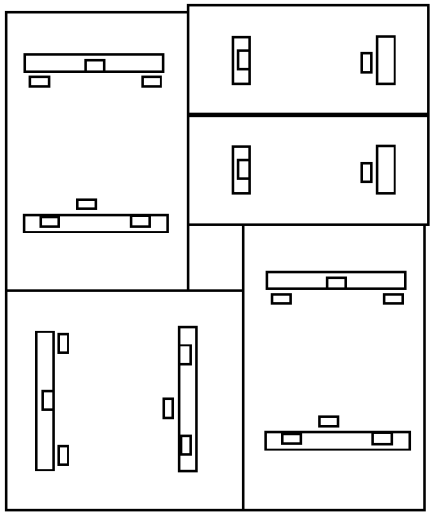
FIGS. 47A-47C are diagrams of layouts of columns, according to other embodiments.
Figure 47B:
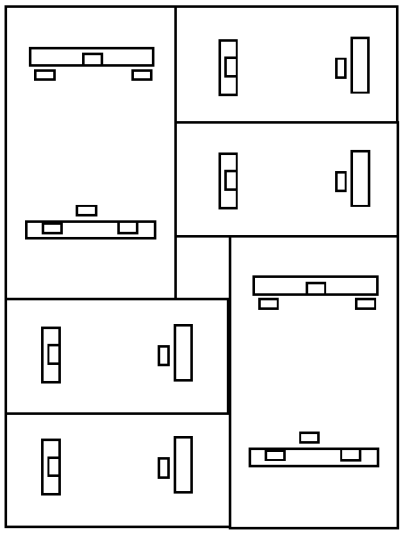
Figure 47C:
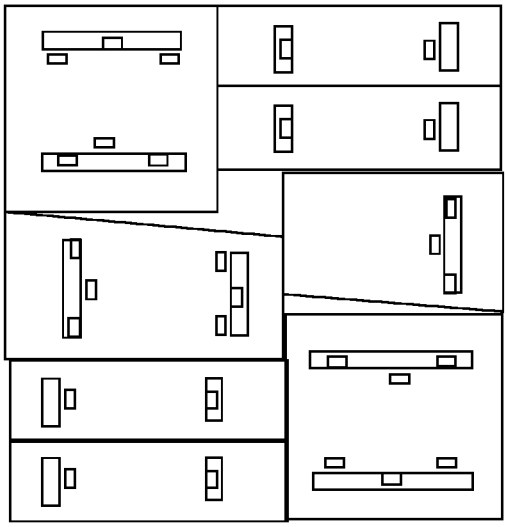

FIGS. 44-46 show various layouts for placing blocks 2002, 2004, 2006, 2008, 2010, 2012, 2014 in first and second courses 2050, 2052, respectively, of a wall. FIG. 43 shows an example of a block-connecting pin 2051 that can be used to interconnect the blocks of the first course and the blocks of the second course. FIGS. 47A-47C show various block layouts for forming columns.

Figure 48:
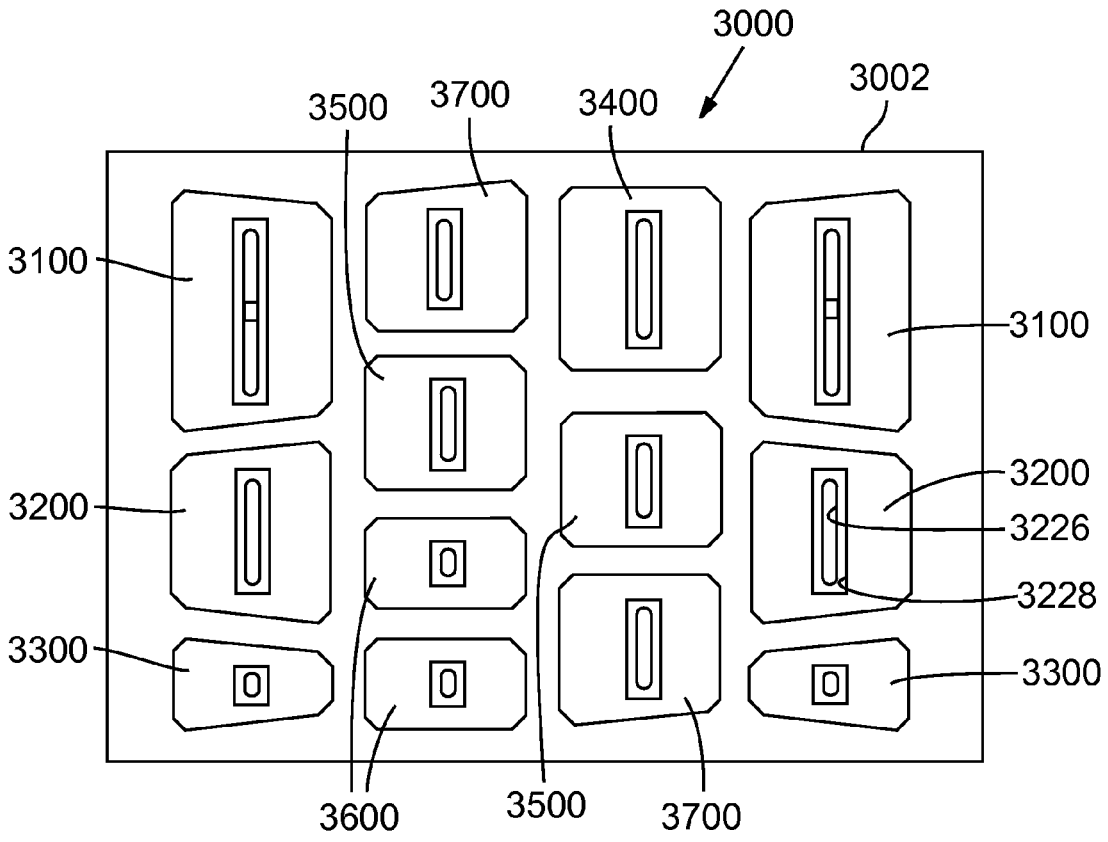
FIG. 48 is a diagram of a mold layout for forming a block system, according to another embodiment.
Figure 49:
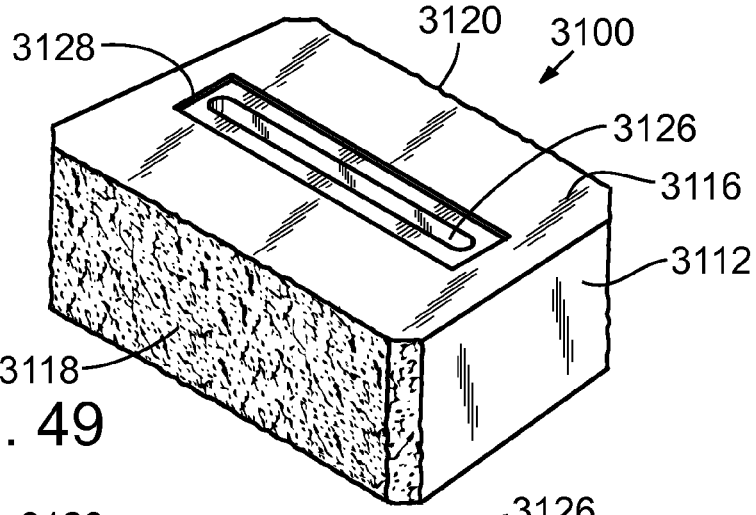
FIG. 49 is a perspective view of a trapezoidal block, according to another embodiment.
Figure 50:
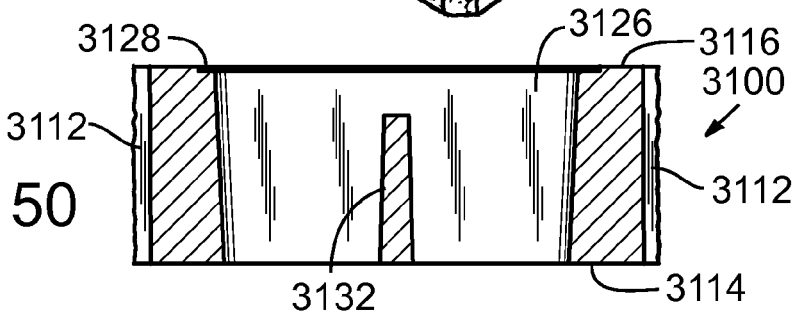
FIG. 50 is a vertical sectional view of the trapezoidal block of FIG. 48.
Figure 51:
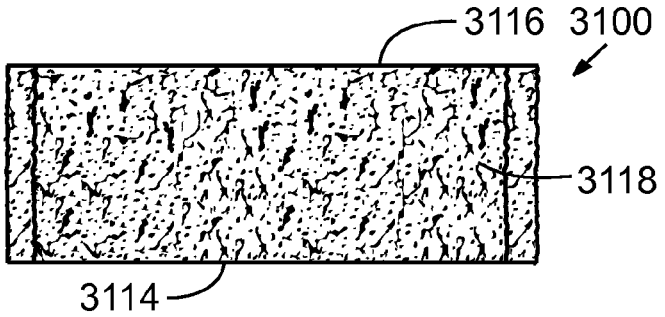
FIG. 51 is a side view of a first face of the trapezoidal block of FIG. 48.

FIG. 48 shows a mold layout for forming a block system 3000 in a mold 3002, according to another embodiment. The block system 3000 in the illustrated embodiment comprises a plurality of reversible blocks, including a first trapezoidal block 3100, a second trapezoidal block 3200, a third trapezoidal block 3300, a first rectangular block 3400, a second rectangular block 3500, a third rectangular block 3600, and an orthogonal block 3700. As shown, the illustrated mold 3002 is configured to form two of the trapezoidal blocks 3100, two of the trapezoidal blocks 3200, two of the trapezoidal blocks 3300, one rectangular block 3400, two of the rectangular blocks 3500, two of the rectangular blocks 3600, and one orthogonal block 3700. The mold 3002 can be modified as desired to form any number of blocks 3100, 3200, 3300, 3400, 3500, 3600, and 3700.

Referring to FIGS. 49-54, the block 3100 comprises opposed side walls or side surfaces 3112, generally parallel bottom and top surfaces 3114, 3116, respectively, and generally parallel first and second faces 3118, 3120, respectively. The side walls 3112 taper inwardly, or converge, as they extend from the first face 3118 to the second face 3120 so that identical acute angles 3122 are formed between the first face 3118 and side walls 3112 and identical obtuse angles 3124 are formed between the second face 3120 and side walls 3112. Hence, the surface area of the first face 3118 is greater than the surface area of the second face 3120. Both faces 3118, 3120 can be formed with roughened surface textures, such as by splitting the block or creating a roughened surface texture on the faces of the block as it is removed from the mold, as described above.

The overall configuration of the block 3100 is similar to the block 10 described above in that the block 3100 is formed with a core 3126 that extends widthwise of the block. However, the block 3100 need not be formed with any minor core sections that extend perpendicular to the core 3126. The core 3126 desirably is positioned equidistant from the first and second faces 3118, 3120. A recessed portion 3128 can be formed in the upper surface 3116 surrounding the core 3126. The core 3126 can be formed with an integral gusset 3132 at the bottom of the block to strengthen the block and help resist breakage during the tumbling process. The core 3126 is adapted to cooperate with a block-connecting element 3150 (FIG. 74-79) to interconnect vertically adjacent blocks in a wall, as further described below. In the illustrated embodiment, except for the core 3126, which forms openings at the upper and lower surfaces of the block, the upper and lower surfaces are substantially flat and uninterrupted without any projections, depressions, openings or slots.

The second trapezoidal block 3200 (FIG. 48) can have the same overall shape as the first trapezoidal block 3100 but has a width that is smaller than that of the first trapezoidal block 3100 (the width of a block being defined as the distance from one side wall to the other along a straight line parallel to the first and second faces of the block). Like the first trapezoidal block 3100, the second trapezoidal block 3200 can be formed with a core 3226 extending the height of the block for receiving a block-connecting element 3150, and can be formed with a recessed portion 3228 surrounding the core 3226 at the upper surface of the block. Like block 3110, both faces of the block 3200 desirably are provided with a roughened surface texture.

Referring to FIGS. 55-58, the third trapezoidal block 3300 has the same overall shape as the first and second trapezoidal blocks but has a width that is smaller than that of the first and second trapezoidal blocks 3110, 3200. The block 3300 comprises opposed side walls or side surfaces 3312, generally parallel bottom and top surfaces 3314, 3316, respectively, and generally parallel first and second faces 3318, 3320, respectively. The side walls 3312 taper inwardly, or converge, as they extend from the first face 3318 to the second face 3320 so that acute angles 3322 are formed between the first face 3318 and side walls 3312 and obtuse angles 3324 are formed between the second face 3320 and side walls 3312. Hence, the surface area of the first face 3318 is greater than the surface area of the second face 3320. Like block 3110, both faces 3318, 3320 desirably are provided with a roughened surface texture. The block 3300 can be formed with an opening 3326 for receiving at least one block-connecting element 3150, and can be formed with a recessed portion 3328 surrounding the opening 3326 at the upper surface of the block. The opening 3326 in the illustrated embodiment does not extend the full height of the block, and therefore can be referred to as a partial core.

Figure 65:
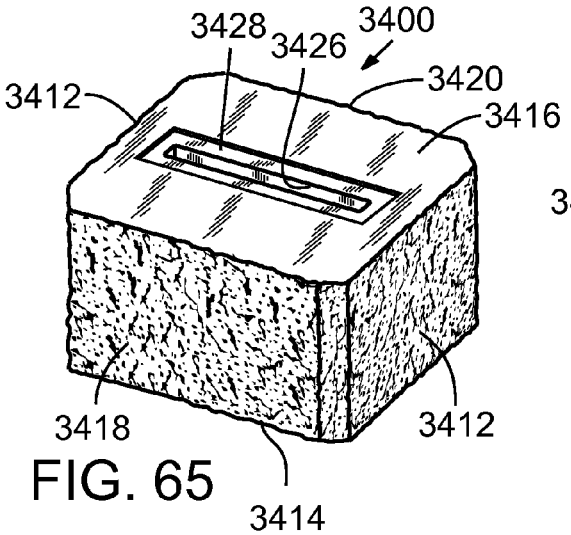
FIG. 65 is a perspective view of a rectangular block, according to another embodiment.
Figure 66:
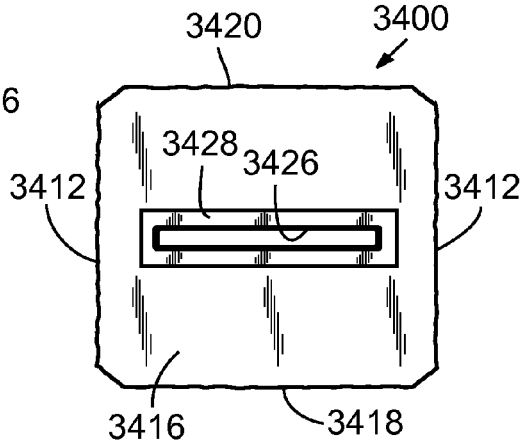
FIG. 66 is a top view of the rectangular block of FIG. 65.
Figure 67:
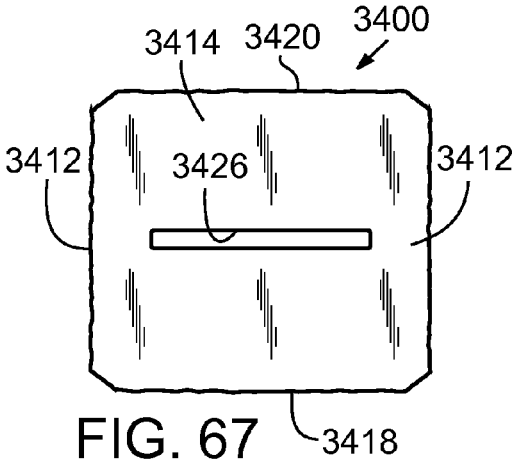
FIG. 67 is a bottom view of the rectangular block of FIG. 65.

Referring to FIGS. 65-67, the first rectangular block 3400 comprises opposed, generally parallel side walls or side surfaces 3412, generally parallel bottom and top surfaces 3414, 3416, respectively, and generally parallel first and second faces 3418, 3420, respectively, of the same overall dimensions and area. Desirably, both faces 3418, 3420 and both side walls 3412 are provided with a roughened surface texture. The block 3400 can be formed with a core 3426 extending the height of the block for receiving a block-connecting element 3150, and can be formed with a recessed portion 3428 surrounding the core 3426 at the upper surface of the block.

Figure 59:
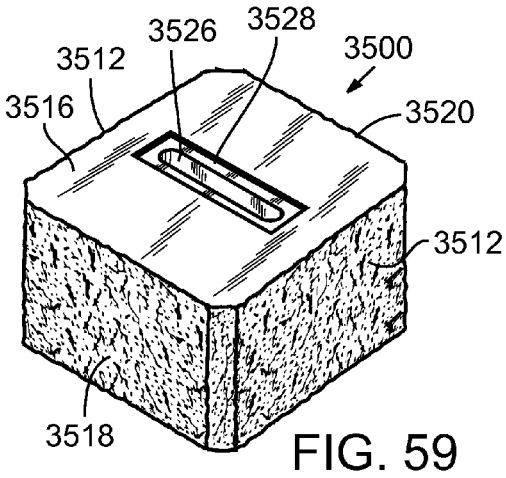
FIG. 59 is a perspective view of a rectangular block, according to another embodiment.
Figure 60:
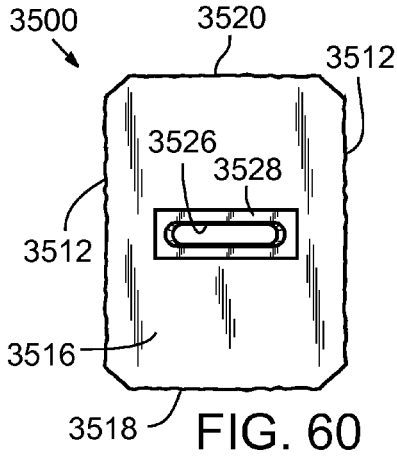
FIG. 60 is a top view of the rectangular block of FIG. 59.
Figure 61:
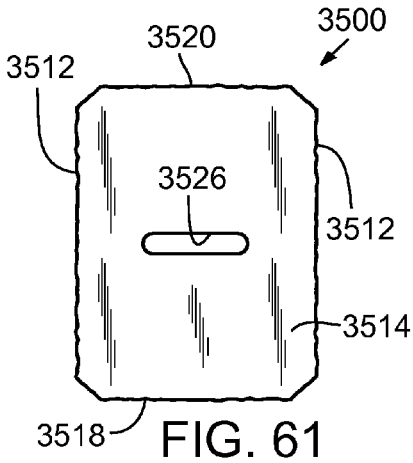
FIG. 61 is a bottom view of the rectangular block of FIG. 59.

Referring to FIGS. 59-61, the second rectangular block 3500 has the same overall shape as the first rectangular block 3400 but has a width that is smaller than that of the first rectangular block 3400. The second rectangular block 3500 comprises opposed, generally parallel side walls or side surfaces 3512, generally parallel bottom and top surfaces 3514, 3516, respectively, and generally parallel first and second faces 3518, 3520, respectively, of the same overall dimensions and area. Desirably, both faces 3518, 3520 and both side walls 3512 are provided with a roughened surface texture. The block 3500 can be formed with a core 3526 extending the height of the block for receiving a block-connecting element 3150, and can be formed with a recessed portion 3528 surrounding the core 3526 at the upper surface of the block.

Figure 62:
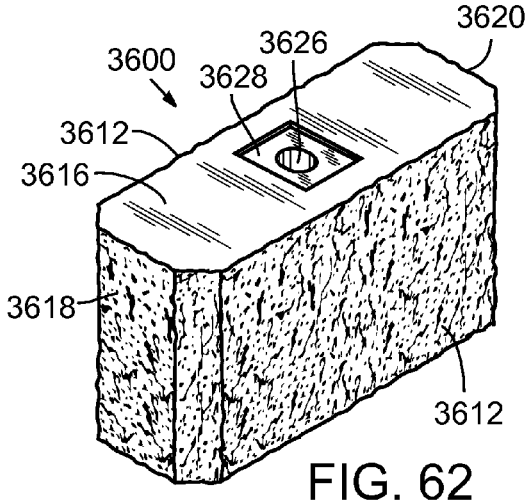
FIG. 62 is a perspective view of a rectangular block, according to another embodiment.
Figure 63:
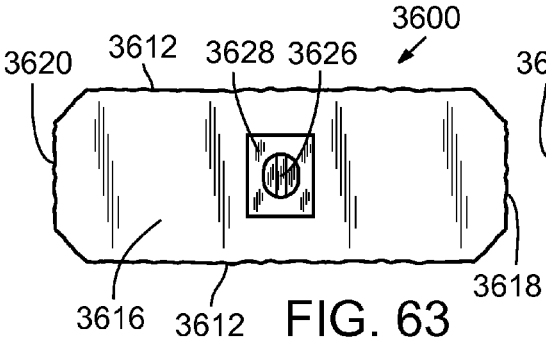
FIG. 63 is a top view of the rectangular block of FIG. 62.
Figure 64:
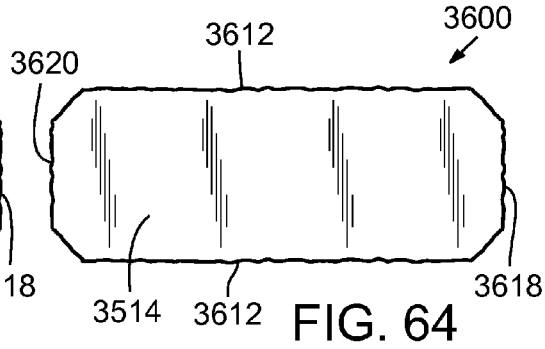
FIG. 64 is a bottom view of the rectangular block of FIG. 62.

Referring to FIGS. 62-64, the third rectangular block 3600 has the same overall shape as the first and second rectangular blocks 3400, 3500 but has a width that is smaller than that of the first and second rectangular blocks 3400, 3500. The third rectangular block 3600 comprises opposed, generally parallel side walls or side surfaces 3612, generally parallel bottom and top surfaces 3614, 3616, respectively, and generally parallel first and second faces 3618, 3620, respectively, of the same overall dimensions and area. Desirably, both faces 3618, 3620 and both side walls 3612 are provided with a roughened surface texture. The block 3600 can be formed with an opening, or partial core, 3626 for receiving a block-connecting element 3150, and can be formed with a recessed portion 3628 surrounding the core 3626 at the upper surface of the block.

Figure 71:
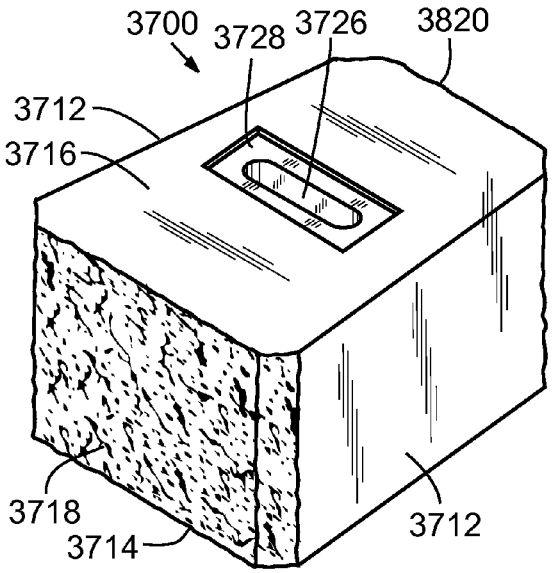
FIG. 71 is a perspective view of an orthogonal block, according to another embodiment.
Figure 72:
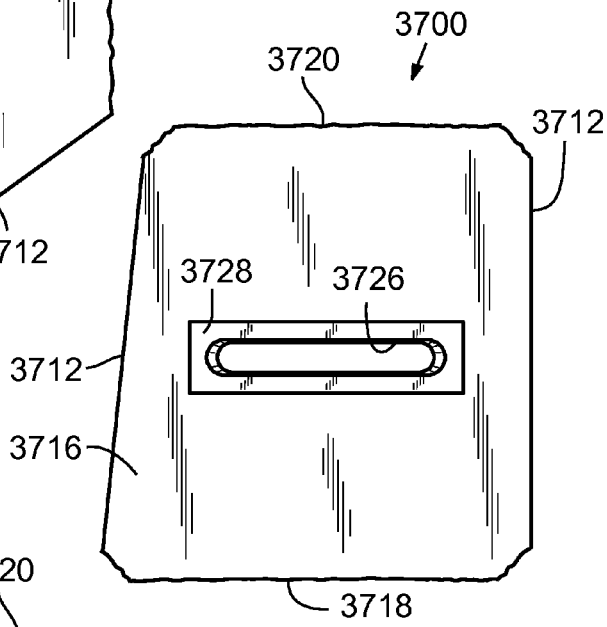
FIG. 72 is a top view of the orthogonal block of FIG. 71.
Figure 73:
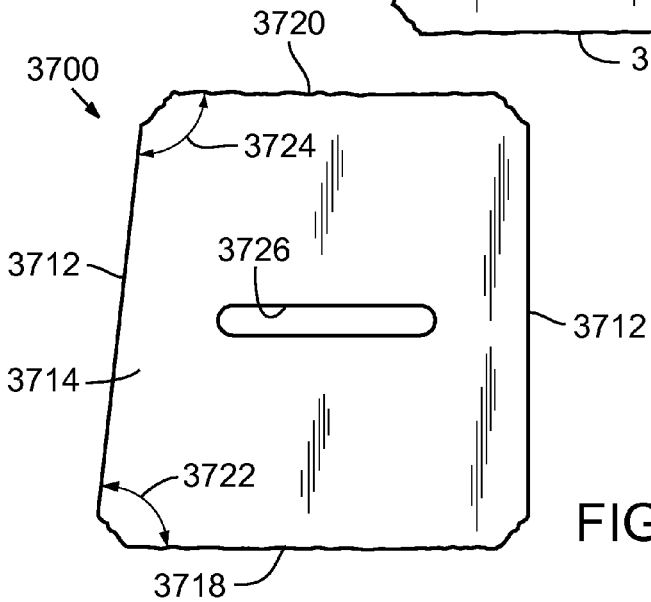
FIG. 73 is a bottom view of the orthogonal block of FIG. 71.
Figure 74:
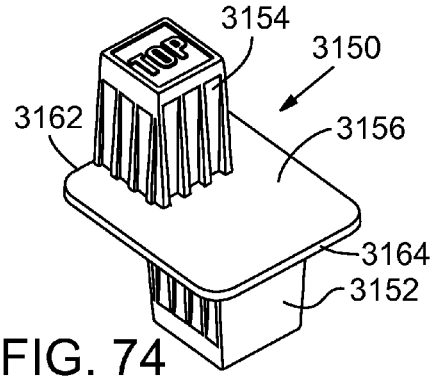
FIG. 74 is a perspective view of a block-connecting element, according to another embodiment.
Figure 75:
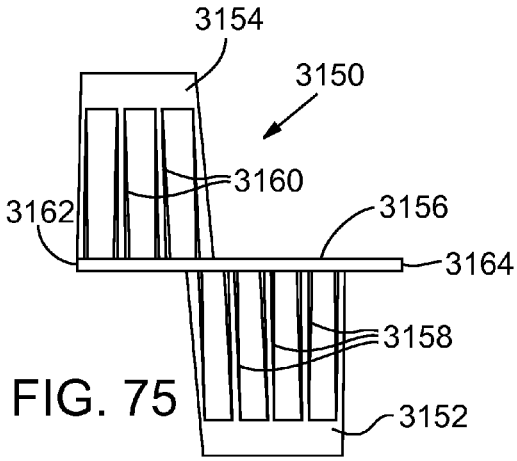
FIG. 75 is a side view of the block-connecting element of FIG. 74.
Figure 76:
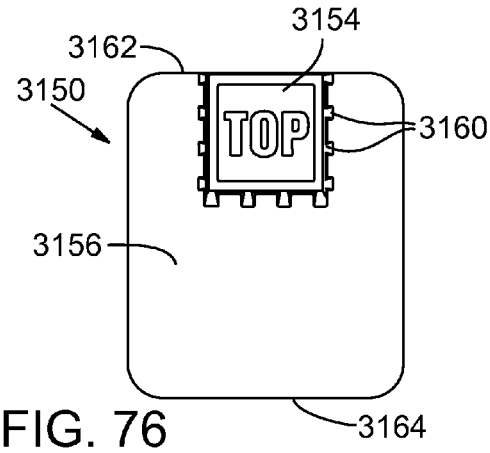
FIG. 76 is a top view of the block-connecting element of FIG. 74.
Figure 77:
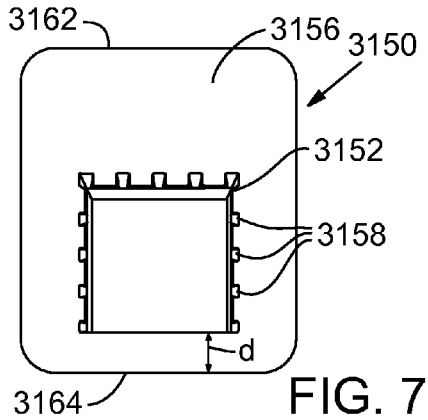
FIG. 77 is a bottom view of the block-connecting element of FIG. 74.
Figure 78:
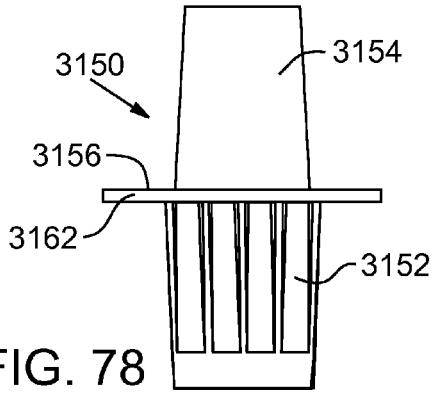
FIG. 78 is a rear-side view of the block-connecting element of FIG. 74.
Figure 79:
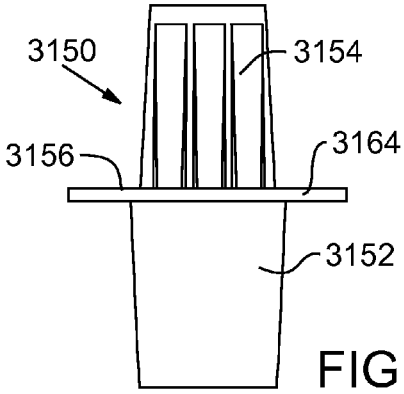
FIG. 79 is a front-side view of the block-connecting element of FIG. 74.

Referring to FIGS. 71-73, the orthogonal block 3700 comprises opposed side walls or side surfaces 3712, generally parallel bottom and top surfaces 3714, 3716, respectively, and generally parallel first and second faces 3718, 3720, respectively. One side wall 3712 is perpendicular (orthogonal) to the first and second faces 3718, 3720 while the other side wall 3712 forms an acute angle 3722 with the first face 3718 and an obtuse angle 3724 with the second face 3720. Hence, the surface area of the first face 3718 is greater than the surface area of the second face 3720. Both faces 3718, 3720 desirably are provided with a roughened surface texture. The block 3700 can be formed with a core 3726 extending the height of the block for receiving a block-connecting element 3150, and can be formed with a recessed portion 3728 surrounding the core 3726 at the upper surface of the block.

Figure 68:
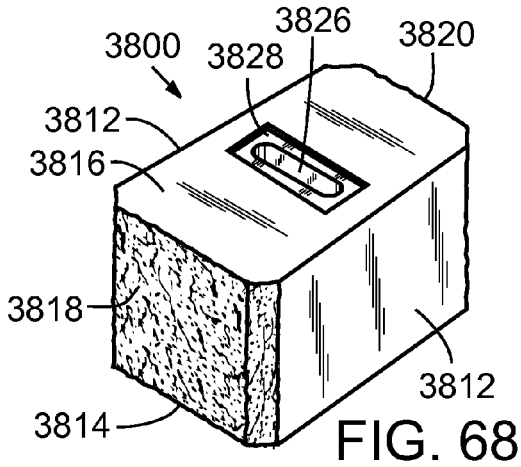
FIG. 68 is a perspective view of an orthogonal block, according to another embodiment.
Figure 69:
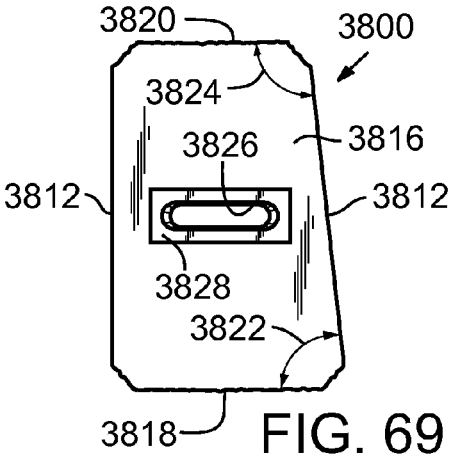
FIG. 69 is a top view of the orthogonal block of FIG. 68.
Figure 70:
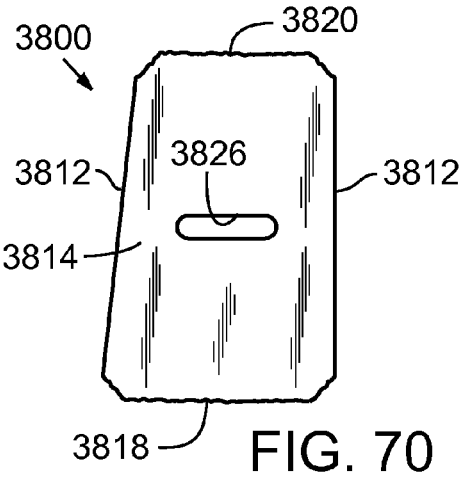
FIG. 70 is a bottom view of the orthogonal block of FIG. 68.

Referring to FIGS. 68-70, the block system 3000 can further include a second orthogonal block, indicated at 3800. Although not shown in FIG. 48, the mold 3002 can be configured to form one or more of blocks 3800. The second orthogonal block 3800 has the same overall shape as the first orthogonal block 3700 but has a width that is less than that of the first orthogonal block 3700. The block 3800 comprises opposed side walls or side surfaces 3812, generally parallel bottom and top surfaces 3814, 3816, respectively, and generally parallel first and second faces 3818, 3820, respectively. One side wall 3812 is perpendicular (orthogonal) to the first and second faces 3818, 3820 while the other side wall 3812 forms an acute angle 3822 with the first face 3818 and an obtuse angle 3824 with the second face 3820. Hence, the surface area of the first face 3818 is greater than the surface area of the second face 3820. Both faces 3818, 3820 desirably are provided with a roughened surface texture. The block 3800 can be formed with a core 3826 extending the height of the block for receiving a block-connecting element 3150, and can be formed with a recessed portion 3828 surrounding the core 3826 at the upper surface of the block.

Figure 52:
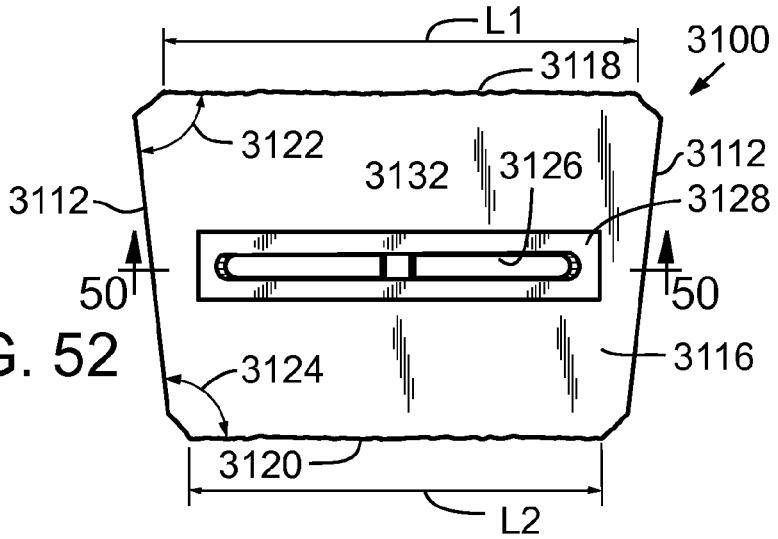
FIG. 52 is a top view of the trapezoidal block of FIG. 48.
Figure 53:
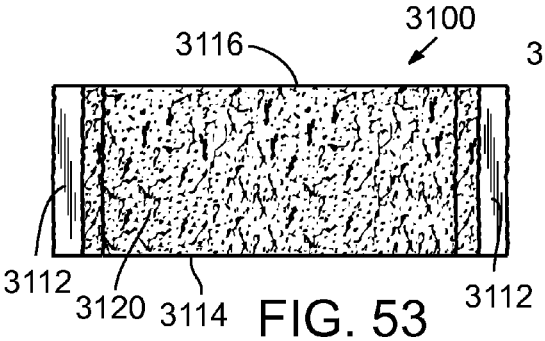
FIG. 53 is side view of a second face of the trapezoidal block of FIG. 48.
Figure 54:
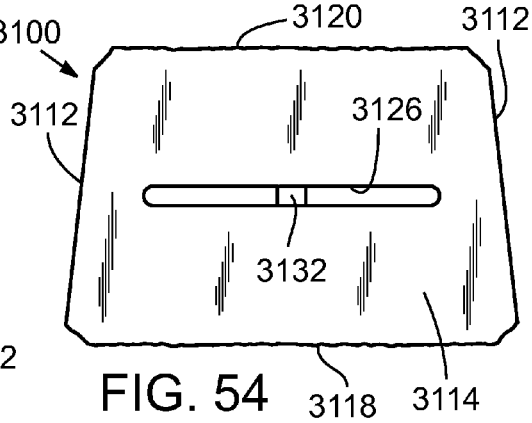
FIG. 54 is a bottom view of the trapezoidal block of FIG. 48.
Figure 55:
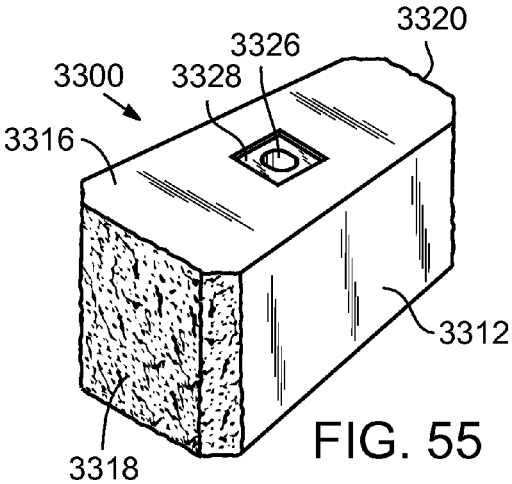
FIG. 55 is a perspective view of a trapezoidal block, according to another embodiment.
Figure 57:
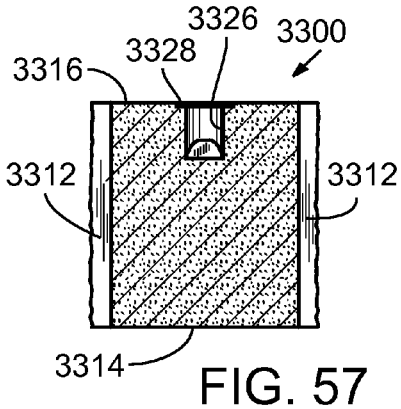
FIG. 57 is a top view of the trapezoidal block of FIG. 56.
Figure 56:
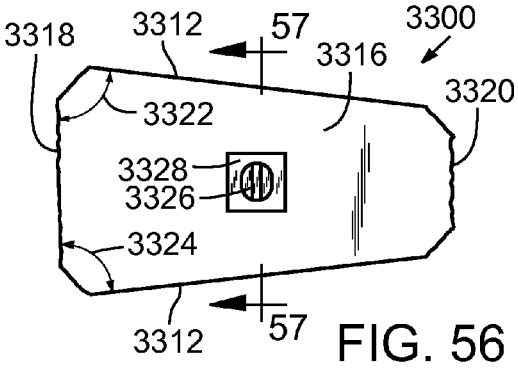
FIG. 56 is a vertical sectional view of the trapezoidal block of FIG. 56.
Figure 58:
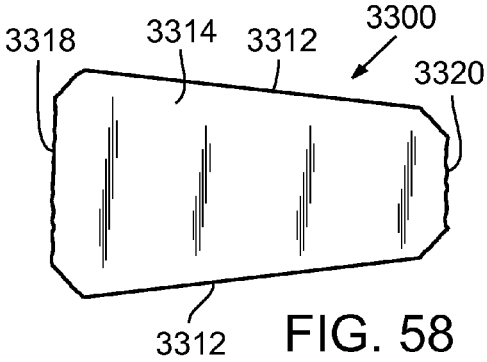
FIG. 58 is a bottom view of the trapezoidal block of FIG. 56.

Each block in set 3000 desirably has the same height (distance between the upper and lower surfaces) and depth (distance between the first and second faces). In one specific embodiment, each block 3100, 3200, 3300, 3400, 3500, 3600, 3700, 3800 has a height of 6 inches and a depth of 10.5 inches. The first face 3118 of block 3110 has a length L1 (defined as the distance between the side walls 3112 at the first face 3118 as shown in FIG. 52) of 16 inches and the second face 3120 has a length L2 of 14 inches (defined as the distance between the side walls 3112 at the second face 3120 as shown in FIG. 52). The first face 3218 of block 3200 has a length of 12 inches and the second face 3220 has a length of 10 inches. The first face 3318 of block 3300 has a length of 6 inches and the second face 3320 has a length of 4 inches. The faces 3418, 3420 of block 3400 have a length of 12 inches. The faces 3518, 3520 of block 3500 have a length of 9 inches. The faces 3618, 3620 of block 3600 have a length of 6 inches. The first face 3718 of block 3700 has a length of 10 inches and the second face 3720 has a length of 9 inches. The first face 3818 of block 3800 has a length of 7 inches and the second face 3820 has a length of 6 inches. Given face sizes above, the blocks 3100, 3200, 3300, 3400, 3500, 3600, 3700, 3800 can provide a total of eight possible face sizes that can be exposed in the surface of a wall. In another embodiment, the blocks 3100, 3200, 3300, 3400, 3500, 3600, 3700, 3800 can have the dimensions provided above except that each block has a height of 8 inches instead of 6 inches.

As with block system 2, the blocks of system 3000 can be formed "top up" in a mold such that the upper surfaces of the blocks (e.g., upper surface 3116 of block 3100) face upwardly when they are formed in a mold. Multiple core formers (not shown) supported by a bar above the mold 3002 can be used to form the cores (e.g., core 3126) and recessed portions (e.g., recessed portion 3128) in the blocks.

As noted above, each of blocks 3100, 3200, 3300, 3400, 3500, 3600, 3700, 3800 is formed with a respective core that is configured to receive one or more block-connecting elements 3150 (FIGS. 74-79) for interconnecting vertically adjacent blocks in a wall. The block-connecting element 3150 can be referred to as a "three-way" block-connecting element (or "three-way" alignment plug) because it can be positioned in three different positions within a core of a block to permit vertical, set forward, or set back placement of blocks in a course relative to the blocks in an adjacent lower course, as further described below.

As shown in FIGS. 74-79, the block-connecting element 3150 comprises a lower portion, or projection, 3152, an upper portion, or projection, 3154, and an intermediate flange portion 3156 separating the upper and lower portions. The lower portion 3152 can be formed with vertically extending, spaced-apart ribs 3158 that extend outwardly from one or more sides of the lower portion (e.g., in the illustrated embodiment, the ribs 3158 are formed on three sides of the lower portion). The ribs 3158 desirably taper in height extending in a direction from the flange portion 3156 to the lower end of the lower portion 3152. When inserted into a block, the ribs 3158 can contact one or more inner surfaces of a core of the block to assist in frictionally retaining the block-connecting element within the block. Likewise, the upper portion 3154 can be formed with vertically extending, spaced-apart ribs 3160 that extend outwardly from one or more sides of the upper portion (e.g., in the illustrated embodiment, the ribs 3160 are formed on three sides of the upper portion). The ribs 3160 desirably taper in height extending in a direction from the flange portion 3156 to the upper end of the upper portion 3154. When inserted into a block, the ribs 3160 can contact one or more inner surfaces of a core of the block to assist in frictionally retaining the block-connecting element within the block.

The upper portion 3154 is horizontally offset from the lower portion 3152; thus, the upper portion 3154 is located closer to a forward edge 3162 of the flange portion 3156 and the lower portion 3152 is located closer to a rear edge 3164 of the flange portion 3156. In the illustrated embodiment, the upper portion 3154 is aligned with the forward edge 3162 while the lower portion 3152 is spaced slightly from the rear edge 3163 a distance d.

Figure 80:
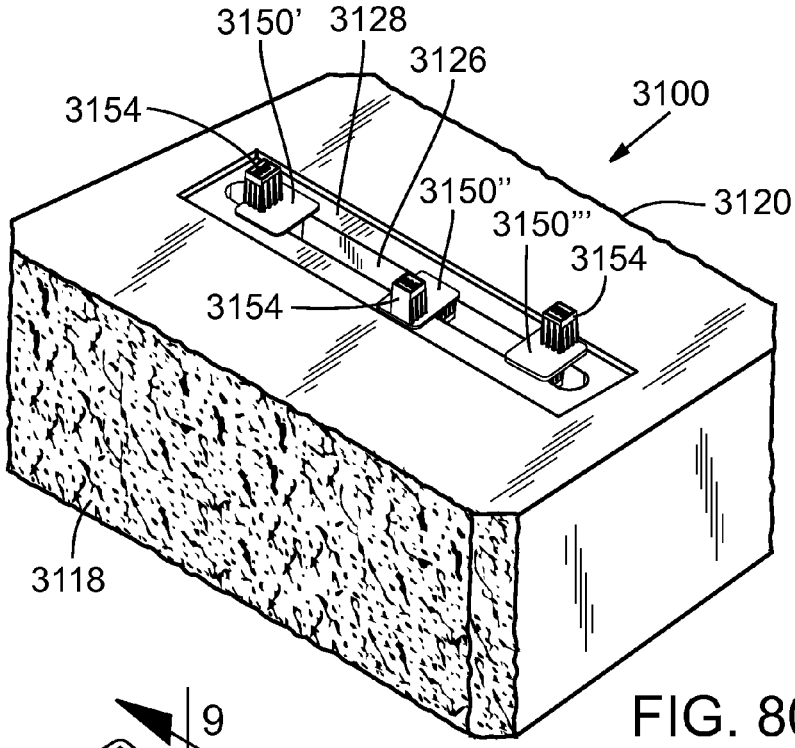
FIG. 80 is a perspective view of a trapezoidal block, according to another embodiment.

FIG. 80 shows the three positions of the block-connecting element 3150 in a block (e.g., block 3100). Block-connecting element 3150' is in a neutral position in which the upper portion 3154 is vertically aligned with the core 3126 for constructing a substantially vertical wall. As shown, the recessed portioned 3128 is sized to receive the flange portion 3156 such that it sits flush with or slightly below the upper surface of the block.

Figure 81:
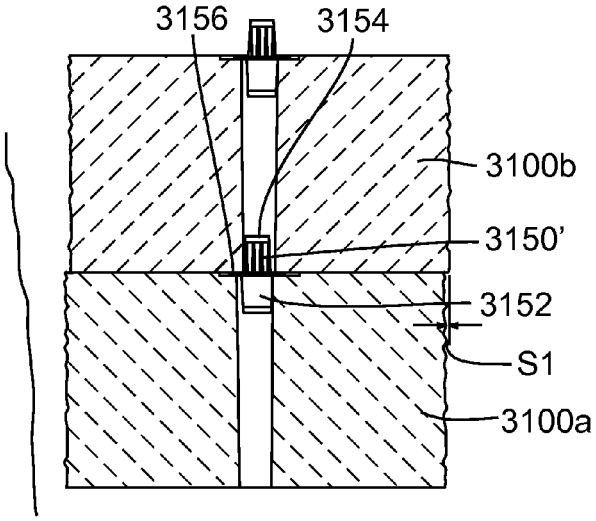
FIG. 81 is a vertical sectional view of the block-connecting element of FIG. 74 attaching two blocks, in which the block-connecting element is in a neutral position to form a substantially vertical wall.

FIG. 81 shows a lower block 3100*a* connected to an upper block 3100*b* with a block-connecting element 3150' positioned in the neutral position. As shown, the lower portion 3152 extends into the core of the lower block 3100*a* and the upper portion 3154 extends into the core of the upper block 3100*b*. This allows the upper block 3100*b* to be vertically aligned with the lower block 3100*a* to form a vertical wall having a neutral batter. In the illustrated embodiment, the width of the core is slightly greater than the width of the upper and lower portions of the block connecting element for ease of installation, which leaves a very small gap (about ⅛ inch) between the inner surface of the core and the adjacent side of the block-connecting element. Thus, if desired, the upper block 3100*b* can be shifted slightly in the forward direction so that the inner wall of the core of the upper block contacts the upper portion of the block-connecting element. In the illustrated embodiment, the upper block 3100*a* is shifted forward relative to the lower block 3100*a* a distance S1 of about ⅛ inch, which establishes a batter of less than one degree. As used herein, a "neutral batter" or "substantially neutral batter" refers to blocks that are vertically aligned without a batter or have a batter of less than one degree (positive or negative).

Figure 82:
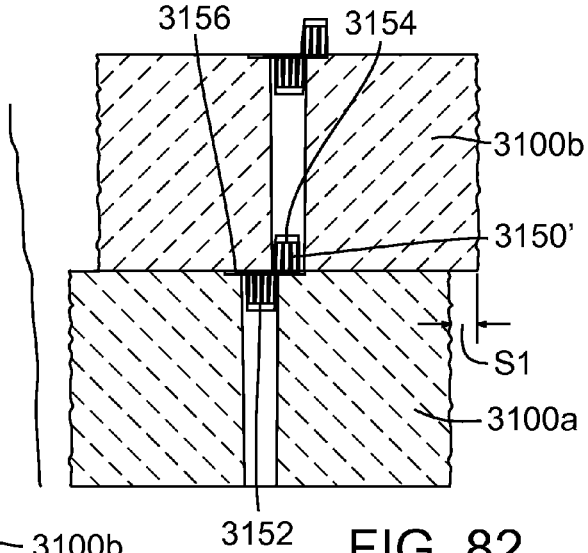
FIG. 82 is a vertical sectional view of the block-connecting element of FIG. 74 attaching two blocks, in which the block-connecting element is in a forward position to form a wall having a positive batter.

Block-connecting element 3150" in FIG. 80 is in a forward position in which the upper portion 3154 is offset toward one face of the block (face 3118 in the illustrated example) and toward the front of the lower course for constructing a wall with a negative batter. Thus, in this case, the upper portion 3154 of the block-connecting element is not vertically aligned above the core 3126. FIG. 82 shows a lower block 3100*a* connected to an upper block 3100*b* with a block-connecting element 3150" positioned in the forward position. This allows the upper block 3100*b* to be set forward with respect to the lower block 3100*a* a distance S1 to form a wall having a negative batter.

Figure 83:
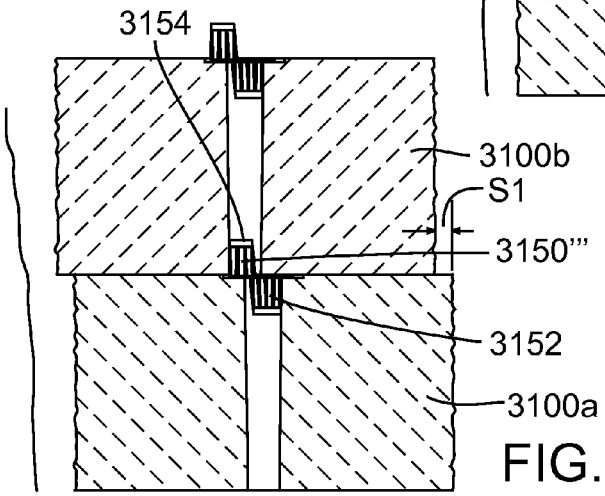
FIG. 83 is a vertical sectional view of the block-connecting element of FIG. 74 attaching two blocks, in which the block-connecting element is in a rearward position to form a wall having a negative batter.

Block-connecting element 3150'" in FIG. 80 is in a rearward position in which the upper portion 3154 is offset toward the opposite face of the block (face 3120 in the illustrated example) and toward the rear of the lower course for constructing a wall with a positive batter. Thus, in this case, the upper portion 3154 of the block-connecting element is not vertically aligned above the core 3126. FIG. 83 shows a lower block 3100*a* connected to an upper block 3100*b* with a block-connecting element 3150'" positioned in the rearward position. This allows the upper block 3100*b* to be set back with respect to the lower block 3100*a* a distance S1 to form a wall having a positive batter.

FIGS. 80-83 illustrate the technique for connecting any two blocks of block system 3000 in a vertical, set forward or set back relationship. It should be noted that the courses of a wall can be formed from any combination of blocks 3100, 3200, 3300, 3400, 3500, 3600, 3700, 3800 interconnected to each other with block-connecting elements 3150. Moreover, if desired, more than one block-connecting element can be used to interconnect a lower block with an upper block. In addition, a block can be connected to two blocks in a vertically adjacent course when the blocks are arranged in a running bond pattern, as described above. The blocks of system 3000 can be used to construct any of the wall or column configurations described herein.

As with the blocks of the block system 2 described above, the core of a block (e.g., core 3126) forms an opening or slot at the upper surface of the block to receive the lower portion 3152 of a block-connecting element and an opening or slot at the lower surface of the block to receive the upper portion 3154 of a block-connecting element. In other words, an upper portion of the core forms an opening or slot in the upper surface of the block and a lower portion of the core forms an opening or slot in the lower surface of the block. In an alternative embodiment, the openings or slots in the upper and lower surface need not be formed by a single core that extends the entire height of the block. For example, the upper surface of the block can have an opening or slot in the shape of a core (e.g., core 3126) that extends downwardly from the upper surface less than the entire height of the block. Similarly, the lower surface of the block can have an opening or slot in the shape of a core that extends upwardly from the lower surface less than the entire height of the block. In such an embodiment, the opening or slot in the upper surface can be separated from the opening or slot in the lower surface by a portion of concrete.

Figure 84:
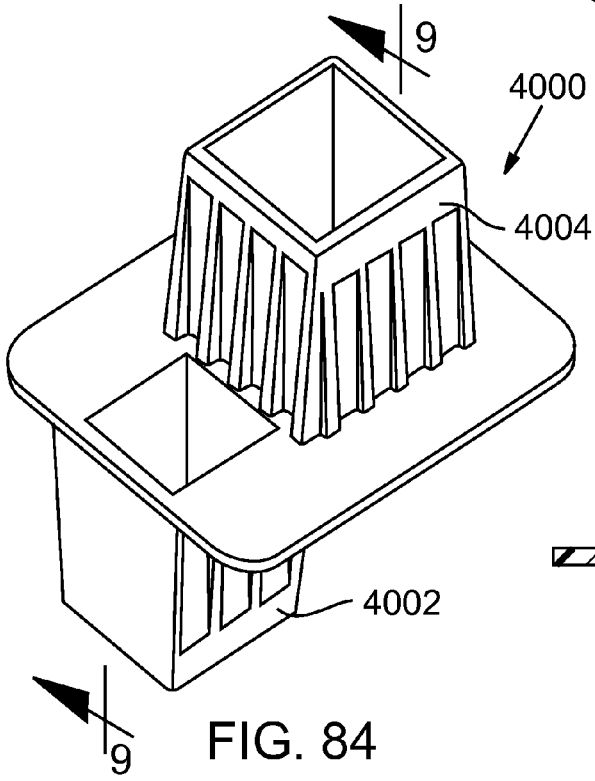
FIG. 84 is a perspective view of a block-connecting element, according to another embodiment.
Figure 85:
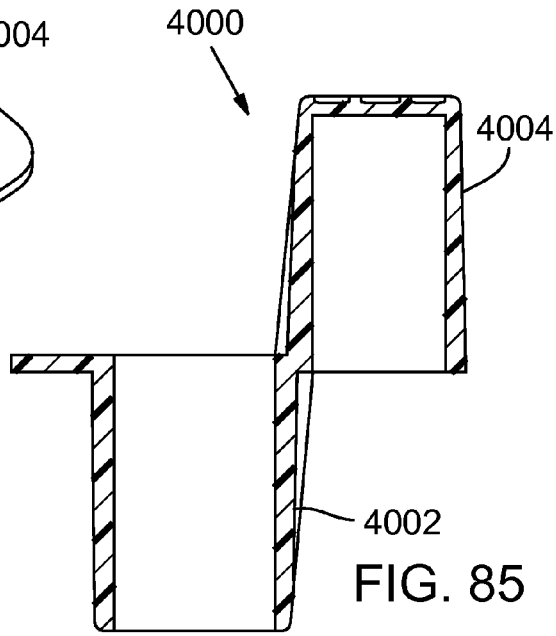
FIG. 85 is a vertical sectional view of the block-connecting element of FIG. 84.

FIGS. 84-85 show a block-connecting element 4000, according to another embodiment. The block-connecting element 4000 is similar in construction to block-connecting element 3150 except that block-connecting element 4000 has a lower portion 4002 and an upper portion 4004 formed with hollow interiors.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A wall block system having at least one block, multiples of the at least one block being suitable for use in constructing a wall from multiple courses of the blocks stacked one upon the other, the wall having a front surface with an irregular block pattern, the wall block system comprising:

a three-way block-connecting element comprising a lower portion and an upper portion;

at least one wall block;

the block having an upper surface spaced apart from a lower surface, thereby defining a block height;

the block having opposed first and second faces, thereby defining the block depth, the area of the first face being greater than the area of the second face, wherein the block is configured such that the first face or second face can serve as an exposed face on one side of the wall;

the block having opposed and non-parallel side surfaces;

the block comprising a slot in the block upper surface that is substantially parallel to and equidistant from the first and second faces and a slot in the block lower surface that is substantially parallel to and equidistant from the first and second faces;

the first and second faces configured such that they are capable of being positioned when constructing the wall such that the front surface of the wall is comprised of the first faces of a plurality of the blocks and second faces of a plurality of the blocks to thereby provide an irregular block pattern;

the block-connecting element being configured such that when constructing the wall, the block-connecting element can be positioned in one of at least three different positions with the lower portion of the block-connecting element being received in the slot in the upper surface of a block and the upper portion of the block-connecting element being received in the slot in the lower surface of another block in an overlying course, the at least three different positions comprising a first position, a second position, and a third position, the first position establishing a neutral batter between the blocks interconnected by the block-connecting element, the second position establishing a negative batter between the blocks interconnected by the block-connecting element, and the third position establishing a positive batter between the blocks interconnected by the block-connecting element.

2. The wall block system of claim 1, wherein the slot in the block upper surface and the slot in the block lower surface are upper and lower portions, respectively, of a core that extends the entire height of the block.

3. The wall block system of claim 1, wherein the slot in the block upper surface and the slot in the block lower surface each extends at least a majority of a width of the block measured along a line that is substantially parallel to and equidistant from the first and second faces.

4. The wall block system of claim 3, wherein the slot in the block upper surface is uninterrupted along the entire length of the slot.

5. The wall block system of claim 1, wherein the upper and lower surfaces of the block are continuous and uninterrupted except for the slots in the upper and lower surfaces of the block.

6. The wall block system of claim 2, wherein the block further comprises an integral gusset within the core adjacent the lower surface of the block.

7. The wall block system of claim 1, wherein both the first and second faces are formed with roughened surface textures.

8. The wall block system of claim 1, wherein the upper portion of the block-connecting element is horizontally offset from the lower portion of the block-connecting element.

9. The wall block system of claim 8, wherein the block-connecting element further comprises an intermediate flange portion separating the upper and lower portions.

10. The wall block system of claim 9, wherein the lower and upper portions of the block-connecting element each comprises vertically extending, spaced-apart ribs that extend outwardly from one or more sides of the lower and upper portion, respectively.

11. The wall block system of claim 10, wherein the ribs of the lower and upper portion are tapered in height, the ribs of the lower portion extending in a direction from the flange portion to the lower end of the lower portion and the ribs of the upper portion extending in a direction from the flange portion to the upper end of the upper portion so that when inserted into the slot in a block, the ribs contact one or more inner surfaces of the slot of the block to assist in frictionally retaining the block-connecting element within the block.

12. The wall block system of claim 9, wherein the block further comprises a recessed portion formed in the upper surface surrounding the slot in the upper surface, the recessed portion sized to receive the flange portion of the block-connecting element.

13. The wall block system of claim 1, wherein the at least one wall block comprises first, second, and third blocks, the width of each block being different.

14. The wall block system of claim 1, wherein the at least one wall block comprises first and second blocks, the first block having one side surface that is perpendicular to the first and second faces, the second block has two side surfaces that are non-perpendicular to the first and second faces.

15. The wall block system of claim 14, further comprising an additional wall block having an upper surface spaced apart from a lower surface, opposed first and second faces of equal size, and opposed, parallel side surfaces that are perpendicular to the first and second faces.

16. A method for constructing a wall from wall blocks laid in multiple courses, one upon the other, such that the wall has a front surface with an irregular block pattern, the method comprising:

providing wall blocks, each of the wall blocks having an upper surface spaced apart from a lower surface, thereby defining a block height, each block having opposed first and second faces, the first face having an area greater than the second face, each block having opposed and non-parallel side surfaces, each block comprising a slot in the block upper surface that is substantially parallel to and equidistant from the first and second faces and a slot in the block lower surface that is substantially parallel to and equidistant from the first and second faces;

laying the wall blocks in a first course and a second course overlying the first course such that the front surface of the wall is formed of the first faces of a plurality of the wall blocks and the second faces of a plurality of the wall blocks; and connecting blocks in the first course with blocks in the second course with a plurality of block-connecting elements, each block-connecting element having a lower portion that extends into a slot in the upper surface of a block in the first course and an upper portion that extends into a slot in the lower surface of a block in the second course;

wherein each block-connecting element is positionable in one of at least three different positions between a block of the first course and a block of the second course, including a first position that establishes a neutral batter between a block of the first course and a block of the second course, a second position that establishes a negative batter between a block of the first course and a block of the second course, and a third position that establishes a positive batter between a block of the first course and a block of the second course.

17. The method of claim 16, wherein:

the wall blocks have a roughened surface texture only on the first and second faces; and the act of providing wall blocks comprises providing additional wall blocks that have parallel side surfaces and first and second faces of equal size, and roughened surface textures on both side surfaces and the first and second faces.

18. The method of claim 16, wherein the act of providing wall blocks comprises providing a plurality of identical first blocks having a first width, a plurality of identical second blocks having a second width greater than the first width, and plurality of identical third blocks having a third width greater than the second width.

19. The method of claim 16, wherein connecting the wall blocks in the second course to the wall blocks in the first course comprises connecting the first course to the second course in a manner that results in construction of a substantially vertical wall.

20. The method of claim 19, wherein the upper portion of each block-connecting element is horizontally offset from the lower portion, wherein the block-connecting elements connecting blocks in the first course to blocks in the second course are in the first position in which the upper portion of each block-connecting element is aligned over a slot in the upper surface of a block in the first course.

21. The method of claim 16, wherein connecting the wall blocks in the second course to the wall blocks in the first course comprises connecting the first course to the second course in a manner that results in construction of a front surface which is angled from the vertical.

22. The method of claim 21, wherein the upper portion of each block-connecting element is horizontally offset from the lower portion, wherein the block-connecting elements connecting blocks in the first course to blocks in the second course are in the second position in which the upper portion of each block-connecting element is offset toward to the front of the first course to create a negative batter between the first course and the second course.

23. The method of claim 21, wherein the upper portion of each block-connecting element is horizontally offset from the lower portion, wherein the block-connecting elements connecting blocks in the first course to blocks in the second course are in the third position in which the upper portion of each block-connecting element is offset toward to the rear of the first course to create a positive batter between the first course and the second course.

24. A wall having a front surface and a rear surface, the wall comprising:

at least a first lower course and a second upper course, each course comprising a plurality of wall blocks, each of the wall blocks having an upper surface spaced apart from a lower surface, thereby defining a block height, each block having opposed first and second faces, and opposed side surfaces, each block comprising a slot in the block upper surface that is substantially parallel to and equidistant from the first and second faces and a slot in the block lower surface that is substantially parallel to and equidistant from the first and second faces, wherein at least a portion of the wall blocks in each course have non-parallel side surfaces and first faces having an area greater than the second faces;

the blocks being positioned in the first and second courses such that the front surface of the wall comprises the first faces of a plurality of blocks and second faces of a plurality of blocks to thereby provide an irregular block pattern; and a plurality of three-way block connecting elements, each three-way block connecting element comprising a lower portion and an upper portion horizontally offset from the lower portion, the lower portion of each connecting element being positioned in the slot in the upper surface of a block in the first course and the upper portion being positioned in the slot in the lower surface of a block in the second course.

25. The wall of claim 24, wherein the first faces and second faces of the wall blocks have roughened surface textures to give the appearance of natural stone.

26. The wall of claim 24, wherein the upper portion of each block-connecting element is aligned over a slot in the upper surface of a block in the first course to establish a neutral batter between the blocks of the first course and the blocks of the second course.

27. The wall of claim 24, wherein the upper portion of each block-connecting element is offset toward the front of the first course to create a negative batter between the blocks of the first course and the blocks of the second course.

28. The wall of claim 24, wherein the upper portion of each block-connecting element is offset toward to the rear of the first course to create a positive batter between the blocks of the first course and the blocks of the second course.

29. The wall of claim 24, wherein each block comprises a core extending the height of the block, the core defining the slot in the upper surface of the block and the slot in the lower surface of the block.

* * * * *